US010849815B2

(12) United States Patent
Huang et al.

(10) Patent No.: US 10,849,815 B2
(45) Date of Patent: Dec. 1, 2020

(54) WEARABLE HAND REHABILITATION SYSTEM

(71) Applicant: REHABOTICS MEDICAL TECHNOLOGY CORPORATION, Zhubei (TW)

(72) Inventors: Jian-Jia Huang, Nantou (TW); Shu-Wei Pu, Taichung (TW)

(73) Assignee: REHABOTICS MEDICAL TECHNOLOGY CORPORATION, Zhubei (TW)

( * ) Notice: Subject to any disclaimer, the term of this patent is extended or adjusted under 35 U.S.C. 154(b) by 381 days.

(21) Appl. No.: 15/845,691

(22) Filed: Dec. 18, 2017

(65) Prior Publication Data

US 2018/0168907 A1 Jun. 21, 2018

(30) Foreign Application Priority Data

Dec. 20, 2016 (TW) ..... 105142134 A

(51) Int. Cl.
*A61H 1/02* (2006.01)

(52) U.S. Cl.
CPC ..... *A61H 1/0288* (2013.01); *A61H 1/0285* (2013.01); *A61H 2201/0119* (2013.01);
(Continued)

(58) Field of Classification Search
CPC ..... A61H 1/00; A61H 1/02; A61H 1/0274; A61H 2011/005; A61H 2201/0107; A61H 2201/0157; A61H 2201/12; A61H 2201/1207; A61H 2201/1418; A61H 2201/1635; A61H 2201/1638; A61H 2201/1664; A61H 2201/1666; A61H 2201/1667; A61H 2201/50;
(Continued)

(56) References Cited

U.S. PATENT DOCUMENTS 4,455,019 A * 6/1984 Harris ..... A63B 23/16 482/102
4,875,469 A * 10/1989 Brook ..... A61H 1/0288 601/40

(Continued)

FOREIGN PATENT DOCUMENTS

DE 102015007327 A1 * 8/2016 ..... A61H 1/0288
TW 474206 1/2002

(Continued)

*Primary Examiner* — Justine R Yu
*Assistant Examiner* — Kelsey E Baller
(74) *Attorney, Agent, or Firm* — Muncy, Geissler, Olds & Lowe, P.C.

(57) ABSTRACT

A wearable hand rehabilitation system includes a base, multiple actuating units configured to the base, hand assistive unit and multiple sheaths connected with the actuating units and the hand assistive unit. The base is composed of a cover and a base plate to create a space. The cover is provided with a perforation closed to the middle of the cover to allow every sheath to pass through the perforation, so as to connect with actuating units. When a user put on the wearable hand rehabilitation system, the user could move or rotate his arm to make his five fingers to grab something. The usage of the wearable hand rehabilitation system could evaluate the hand rehabilitation condition of the user.

10 Claims, 24 Drawing Sheets

(52) U.S. Cl.
CPC ..... *A61H 2201/123* (2013.01); *A61H 2201/1215* (2013.01); *A61H 2201/165* (2013.01); *A61H 2201/1638* (2013.01); *A61H 2201/1676* (2013.01); *A61H 2201/5007* (2013.01); *A61H 2201/5061* (2013.01); *A61H 2201/5071* (2013.01); *A61H 2205/065* (2013.01); *A61H 2205/067* (2013.01); *A61H 2230/605* (2013.01)

(58) Field of Classification Search
CPC .... A61H 2201/5007; A61H 2201/5058; A61H 2201/5061; A61H 2201/1697; A61H 2201/169; A61H 2201/165; A61H 2201/149; A61H 2201/1246; A61H 2201/1215; A61H 2205/06; A61H 2205/065; A61H 2205/067; A61F 2005/0155; A61F 2005/587; A61F 2005/453; A61F 2/54; A61F 2/583; A61F 2/585; A61F 2/586; A61F 5/0118; A61F 5/013; A63B 23/16; A63B 21/00; A63B 21/00178; A63B 21/00181; A63B 21/4035; A63B 21/4091; A63B 21/0087; A63B 21/0083; A63B 21/0058; G05G 9/047; G05G 9/04788; F16H 27/02
USPC ..... 601/40, 23
See application file for complete search history.

(56) References Cited

U.S. PATENT DOCUMENTS

| | | | | |
|---|---|---|---|---|
| 5,303,696 | A * | 4/1994 | Boice | A61H 1/0288 482/44 |
| 8,574,178 | B2 | 11/2013 | Tong et al. | |
| 8,881,616 | B2 * | 11/2014 | Dize | G05G 9/047 345/161 |
| 9,375,382 | B2 | 6/2016 | Fausti et al. | |
| 9,566,173 | B2 * | 2/2017 | Ryu | G06F 3/011 |
| 2013/0072829 | A1 | 3/2013 | Fausti | |
| 2013/0261514 | A1 | 10/2013 | Tsui et al. | |
| 2019/0151181 | A1 * | 5/2019 | Lince | A61H 1/0288 |

FOREIGN PATENT DOCUMENTS

| | | | |
|---|---|---|---|
| TW | 500316 | | 8/2002 |
| TW | M355708 | U1 | 5/2009 |
| TW | 201041572 | A1 | 12/2010 |
| TW | 201313217 | A | 4/2013 |
| TW | M495845 | U | 2/2015 |
| TW | 201611793 | A | 4/2016 |
| TW | 201620587 | A | 6/2016 |
| WO | WO2011/117901 | A1 | 9/2011 |
| WO | WO2012/120393 | A | 9/2012 |
| WO | WO2016/117758 | A1 | 7/2016 |

* cited by examiner

WEARABLE HAND REHABILITATION SYSTEM

CROSS-REFERENCE TO RELATED APPLICATIONS

This application claims priority to Taiwan Patent Application No. 105142134, filed Dec. 20, 2016, the content of which are hereby incorporated by reference in their entirety.

FIELD OF THE INVENTION

The present invention relates to a mechanical assistive device or rehabilitation apparatus, particularly relates to a wearable hand rehabilitation system.

BACKGROUND OF THE INVENTION

A wearable mechanical assistive device may be put on human to strength user's local limbs capability by mechanical elements, as well as to help or guide the user to complete the specific tasks. By its high repeatability and reliability of mechanical members, the wearable mechanical assistive device may strength human's limb capability on specific part and push the user's local limb to complete precisely and repeatedly reciprocating action with stable and continuous forces acting on limbs. With the coming of aged society and increasing demands, relative mechanical products have gradually become a main stream.

Because of high complexity and high degrees of freedom of hand anatomy, it is difficult to design a wearable mechanical assistive device to mechanically achieve the same movement capabilities as human hand has. In relative fields of wearable mechanical assistive devices, most of patents are relative to finger rehabilitation and featured by developing finger bending and extension technologies. Besides, the majority of driving ways for assistive device is feedforward passive driving way.

First, for prior references relative to the thin shell exoskeletons, U.S. patent publication No. 20140072829A1, Taiwan Patent Nos. 495845, 474206 and 355708 disclose joint movement by pulling cables. Next, Taiwan Patent No. 500316 discloses a joint movement by guide rod.

Next, for prior references relative to mechanical joint of single slide, U.S. Pat. No. 8,574,179B2 and China Patent No. 101897643B disclose twin slides design. U.S. Pat. No. 8,574,179B2 and China Patent No. 101897643 disclose the rotation center of slide arranged at finger joint. Moreover, Taiwan Patent Nos. 500316 and 355708 disclose a design using single-finger motor as driving force.

Besides, for prior references relative to rehabilitation methods, Taiwan Patent No. 1374734 recites a setting method for periodic variation of joint angles, and Taiwan Patent Publication No. 201440752 discloses a writable specific action model.

Accordingly, the present invention provides a wearable hand rehabilitation system that has light weight and meets hand anatomy.

SUMMARY OF THE INVENTION

According to an objective of the present invention is to provide a wearable hand rehabilitation system, which includes: a hand assistive unit provided with a palm base and an L-shaped like joint connecting part connecting with the palm base, a thumb joint mechanism fixed on the first end of the joint connecting part, a plurality of finger joint mechanisms (also called as four finger joint mechanisms in this invention) respectively fixed on the first end of the palm base, and a plurality of wire concentrator rods fixed on the second end of the palm base; a tension sensing unit positioned adjacent to the hand assistive unit and provided with a plurality of elastic sensing rods; a driving unit positioned adjacent to the tension sensing unit and provided with a plurality of motors that provides rotation angles; a plurality of transmission cables, one end of each transmission cables is connected to the thumb joint mechanism and the four finger joint mechanisms, and another end thereof is connected to the driving unit and contacting its corresponding elastic sensing rod respectively; and a control unit is connected to the driving unit and the tension sensing unit, wherein the thumb joint mechanism is provided with an accommodation space for accommodating a slide linking bar, the accommodation space is formed by at least two sidewalls and provided with a thumb slide on the two sidewalls for pivotally connecting one end of the slide linking bar, one of the sidewalls is provided with a plurality of cable pulleys, and the plurality of cable pulleys enable the transmission cables to contact the cable pulley and the wire concentrator rod; and a finger metacarpophalangeal joint provided with an accommodation space for accommodating the slide linking bar, the accommodation space is formed with at least two sidewalls and provided with a thumb slide on the two sidewalls for pivotally connecting one end of the slide linking bar, one of the sidewalls is provided with the plurality of cable pulleys, and the plurality of cable pulleys enable the transmission cable to contact the cable pulleys and the wire concentrator rods.

According to an objective of the present invention, in wearable hand rehabilitation system of the present invention, with designs of metacarpophalangeal joint equipped with a slide linking bar, the plurality of cable pulleys and the wire concentrator rods, the wearable hand rehabilitation system of the present invention could not be equipped with various sensor components within the thumb joint mechanism or the four finger joint mechanisms (also called as the plurality of finger joint mechanisms in this invention), and be simplized with the drive of transmission cable, which is beneficial in reducing weight and manufacturing cost of assistive device.

According to an objective of the present invention, in wearable hand rehabilitation system of the present invention, with designs of driving unit and metacarpophalangeal joint, the variation of bending angles in thumb joint mechanism or finger joint mechanism can be accurately controlled so as to precisely drive thumb or fingers of patient to execute rehabilitation.

According to an objective of the present invention, with designs of the tension sensing unit and the metacarpophalangeal joint, the feedback force of thumb or four fingers (the four fingers includes index finger, middle finger, ring finger, and pinky finger) can be accurately measured during rehabilitation process, so that the patient's rehabilitation situation can be precisely evaluated, and predetermined values for each patient can be accurately set to prevent the patient in rehabilitation from being injured again.

According to another objective of the present invention is to provide a hand assistive unit with rehabilitation functions herein, which includes:

a palm base including a plane and a L-shaped like joint connecting part with respect to the plane;

a thumb joint mechanism fixed onto the first end of the joint connecting part and provided with an accommodation space for accommodating a slide linking bar, a thumb slide on two sidewalls that forms the accommodation space for pivotally connecting one end of the slide linking bar, and a plurality of cable pulleys on one of the two sidewalls;

the plurality of finger joint mechanisms (also called as four finger joint mechanisms) respectively fixed onto the first end of the palm base, an accommodation space in a finger metacarpophalangeal joint configured for accommodating a slide linking bar and formed by at least two sidewalls, a thumb slide positioned on the sidewalls for pivotally connecting one end of the slide linking bar, and the plurality of cable pulleys on one of two sidewalls;

a plurality of wire concentrator rods on the second end of the palm base; and a plurality of transmission cables, each of the transmission cables provided with one end connected to/with the thumb joint mechanism and the four finger joint mechanisms respectively and another end contacted a wire concentrator rod, and each of transmission cables contacted each of cable pulleys, too.

According to an objective of the present invention, with design of the hand assistive unit, the patient wearing the hand assistive unit of the present invention could feel comfortable because the hand assistive unit could be customizedly designed according to patient's palm shape by assist of medical personnel.

According to an objective of the present invention, by the metacarpophalangeal joint structure, with designs of the slide linking bar, the plurality of cable pulleys and the wire concentrator rods, the hand assistive unit of the present invention may be simply equipped with the transmission cables instead of various sensing elements in the thumb joint mechanism or the finger joint mechanism, but still preserves the usability of proposed mechanisms. Also, weight and manufacturing cost of assistive device could be reduced.

It is still an objective of the present invention is to provide a finger joint mechanism for rehabilitation which includes: a finger metacarpophalangeal joint with an accommodation space for accommodating a slide linking bar, the accommodation space formed by at least two sidewalls, a thumb slide on the sidewalls to pivotally connect one end of the slide linking bar, wherein one of two sidewalls is equipped with a plurality of cable pulleys;

a finger proximal phalanx provided with two open ends and a top end, one of two open ends of the finger proximal phalanx coupled to another end of the slide linking bar, the other open end of the finger proximal phalanx including two sides that is coupled to the top end of the finger proximal phalanx, an assistive pivot hole arranged on the two sides, and a first link part upward protruding from a top surface of the top end;

a finger intermediate phalanx provided with two open ends and a top end, one of two open ends of the finger intermediate phalanx that adjacent to the finger proximal joint is coupled to the other open end of the finger proximal phalanx;

a finger distal joint provided with two open ends and a top end, the open end of the finger distal joint that adjacent to the finger intermediate phalanx is coupled to the other open end of the finger intermediate phalanx, and a top surface of the top end provided with an upward protruding second link part;

a finger driving shaft is constructed by a driving part, a first link arm, a second link arm and a third link arm; each of the driving part, the first link arm, the second link arm and the third link arm respectively includes two open ends, one of two open ends of the first link arm is coupled with one of two open ends of the second link arm, the other open end of the first link arm is coupled with one of two open ends of the driving part, a pair of positioning pivot holes is arranged on one terminal adjacent to an outside of a connecting end of the second link arm and the first link arm, another open end of the driving part is connected to a first link part protruded upward on a top surface of the top end of the finger proximal joint, another open end of the second link arm is connected to a second link part protruded upward on a top surface of the top end of the finger distal joint, one end of the third link arm is connected to a positioning pivot hole and another open end of the third link arm is connected to an assistive pivot hole;

wherein another open end of the driving part is coupled to a first link part protruded from the top end of the finger proximal joint, another open end of the second link arm is coupled to a second link part protruded from the top end of the thumb distal joint, one end of the third link arm is coupled to the positioning pivot holes, and the other open end of the third arm is coupled to the assistive pivot hole;

one end of a first transmission cable fixed onto a motor and another end fixed onto the second link arm, the first transmission cable contacts the first cable pulley at the same time; and one end of a second transmission cable fixed onto the motor and another end fixed onto the second link arm, the second transmission cable contacts the cable pulley, and the second transmission cable further contacts the slide linking bar.

According to an objective of the present invention, with the designs of the finger joint mechanism, the finger slide and the slide linking bar, the finger joint mechanism may provide a virtual center to be a reference center point for the finger proximal phalanx in bending.

According to an objective of the present invention, through the design of the finger joint mechanism, a patient's fingers can be precisely driven to bend by the design of the finger driving shaft, and the feedback force of the user's fingers can be measured during the rehabilitation process, so that the patient's rehabilitation situation can be precisely evaluated.

It is a further objective of the present invention is to provide a thumb joint mechanism for rehabilitation, which includes: a thumb metacarpophalangeal joint with an accommodation space for accommodating a slide linking bar, the accommodation space is formed by at least two sidewalls, a thumb slide is arranged on two sidewalls to pivotally connect to one end of the slide linking bar, and one of the sidewalls is equipped with the plurality of cable pulleys;

a thumb proximal joint provided with two open ends and a top end, one of two open ends of the thumb proximal joint is coupled to the other end of the slide linking bar, the opposite open end provided with two sides coupled to the top end, and a first link part protruded upward on a top surface of the top end;

a thumb distal joint provided with two open ends and a top end, the open end that adjacent to the thumb proximal joint is coupled to the other open end of the thumb proximal joint, and a second link part protruded on a top surface of the top end;

a thumb driving shaft is constructed by a first link part and a second link part, in which the first link part and the second link part includes two open ends respectively. one of two open ends of the first link part is coupled to one of two open ends of the second link part, the other open end of the first link part is coupled to a second link part protruded over a top surface of the top end of the thumb distal joint, and the other open end of the second link part is coupled to the first link part protruded over the top surface of the top end of the thumb proximal joint;

one end of a first transmission cable is fixed onto a motor and the other end is fixed onto the second link part, and the first transmission cable contacts a cable pulley; and one end of a second transmission cable is fixed onto the motor and the other end is fixed onto the second link part, the second transmission cable contacts the cable pulley, and the second transmission cable further contacts the slide linking bar.

According to the objective of the present invention, through the designs of the thumb joint mechanism, by the thumb slide and the slide linking bar, the thumb joint mechanism may form a virtual center as a reference center point for bending of thumb proximal phalanx such that the interference with the finger joint mechanism can be avoided.

According to the objective of the present invention, through the designs of the finger joint mechanism, the design of the thumb driving shaft can accurately drive the bending for a patient's thumb and the feedback force of the patient's thumb may be measured during a rehabilitation process, so that the patient's rehabilitation may be precisely evaluated.

According to a further objective of the present invention is to provide a thumb joint mechanism, which includes a base is constructed by a cover, a base plate, and an accommodation space between the cover and the base plate, a through hole formed close to a central part of the cover; a hand assistive unit is constructed by a thumb joint mechanism and a plurality of finger joint mechanisms. The thumb joint mechanism and the plurality of finger joint mechanisms respectively equipped with a driving shaft At least an actuating unit is positioned on the base plate of the base; a plurality pairs of sheaths, each pairs of sheaths with a hollow space and a transmission cable which is longer than that of the sheaths are put into the sheath and is slidable within the hollow space of the sheath, wherein the actuating unit includes a frame that is constructed by an upper plate including two through holes, a backplate, a bottom plate and a support including a through hole, wherein the upper plate is fixed onto one end of the backplate, and the bottom plate is fixed onto another end of the backplate, so that the bottom plate and the upper plate are parallel positioned at same side of the backplate with height of the backplate in between, and the other open end of the bottom plate is fixed onto a support; a motor that is equipped on the support and provides with a shaft passing through a through hole on the support; a cylindrical spinner that connects to the shaft and provides two parallel grooves with space in between, and a pair of fixing points positioned on an end relative to one side end of the cylindrical spinner; a pair of tension sensing units arranged on the bottom plate and provided with an elastic pulley, an elastic sensing rod, and a tension sensor fixed on the bottom plate, the elastic sensing rod is used to connects the tension sensor and the elastic pulley; wherein each pairs of sheaths are connected to the hand assistive unit with one end and the two through holes on the upper plate are connected with another end, so that one end of the each transmission cable connects to the driving shaft, and another end of the each transmission cable passes around the elastic pulley and contacts the groove and then connects the pair of fixing points with a terminal.

According to an objective of the present invention, the wearable hand rehabilitation system provides full functions for hand rehabilitation. When the user's hand puts on the wearable hand rehabilitation system, the user could move user's arm to grab an object (for example: a ball) with user's fingers under the control of a control unit. The use of the wearable hand rehabilitation system could evaluate the effect of hand rehabilitation of the user.

DETAILED DESCRIPTION OF THE PREFERRED EMBODIMENT

In order to let one of skilled in the art sufficiently understand the technical contents of the present invention, relative embodiments with references to the drawings are provided for illustrating the present invention. However, the fundamental functions and principles relative to wearable hand rehabilitation assistive system of the present invention have been illustrated in relative patents as mentioned in background paragraphs. Thus, following paragraphs only disclose technical features in details relative to the wearable hand rehabilitation assistive system of the present invention. Furthermore, the dimension of components in drawings is not shown in practical sizes and are used to illustrate the functions relative to the technical features of the present invention.

Figure 1:
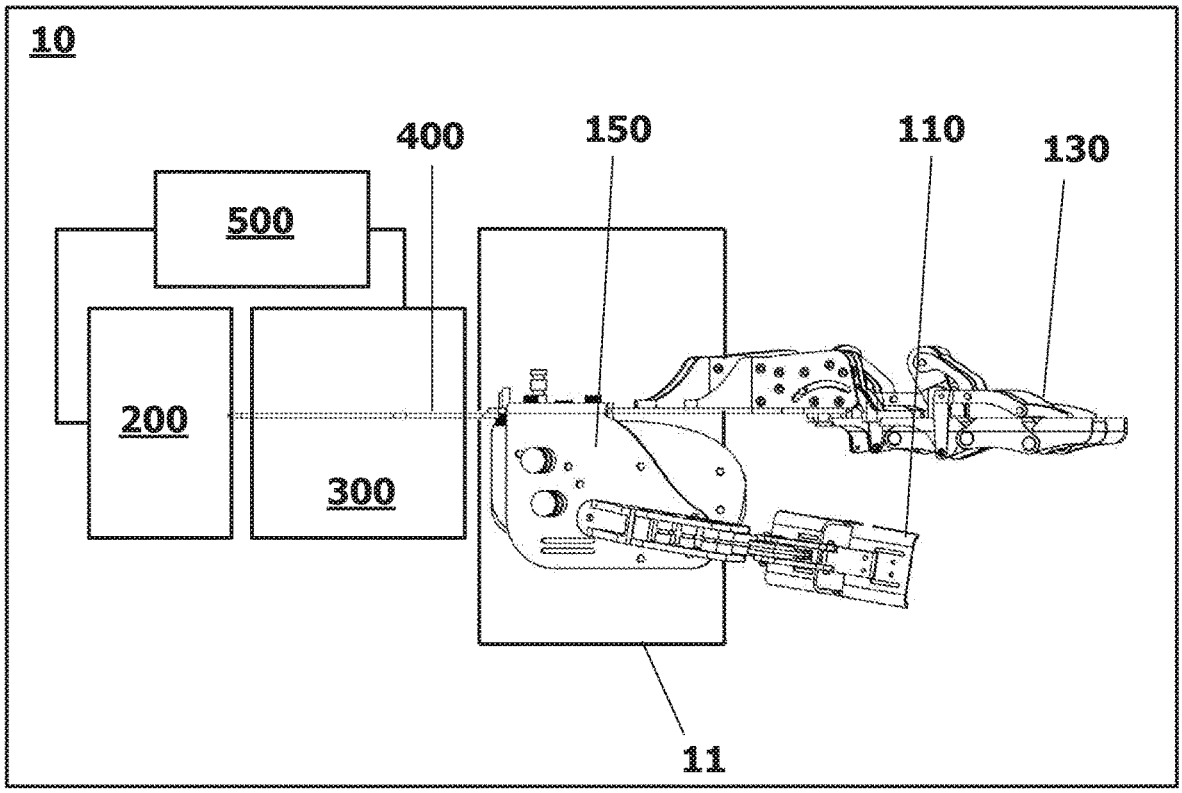
FIG. 1 is a systematic diagram of illustrating a wearable hand rehabilitation system in accordance with the present invention.
Figure 3A:
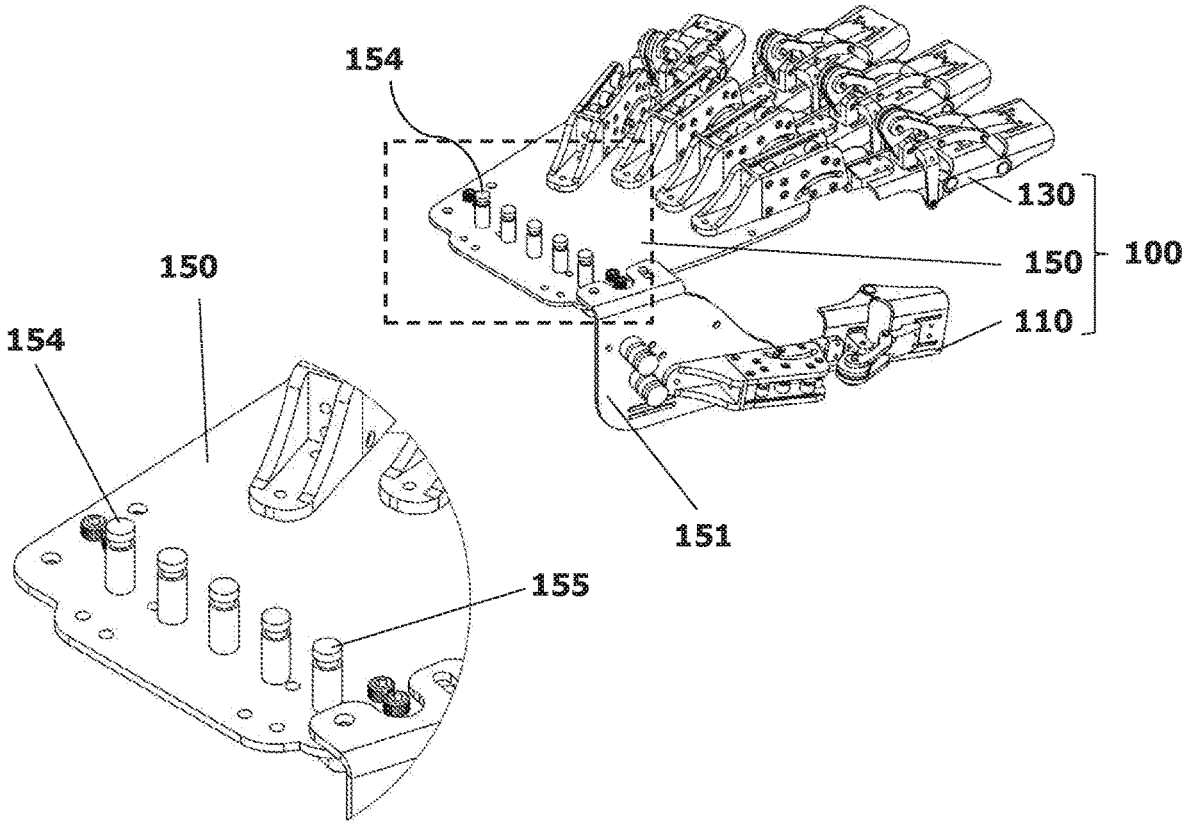
FIG. 3A is an overlooking view of illustrating a palm joint mechanism of a wearable hand rehabilitation system in accordance with the present invention.
Figure 3B:
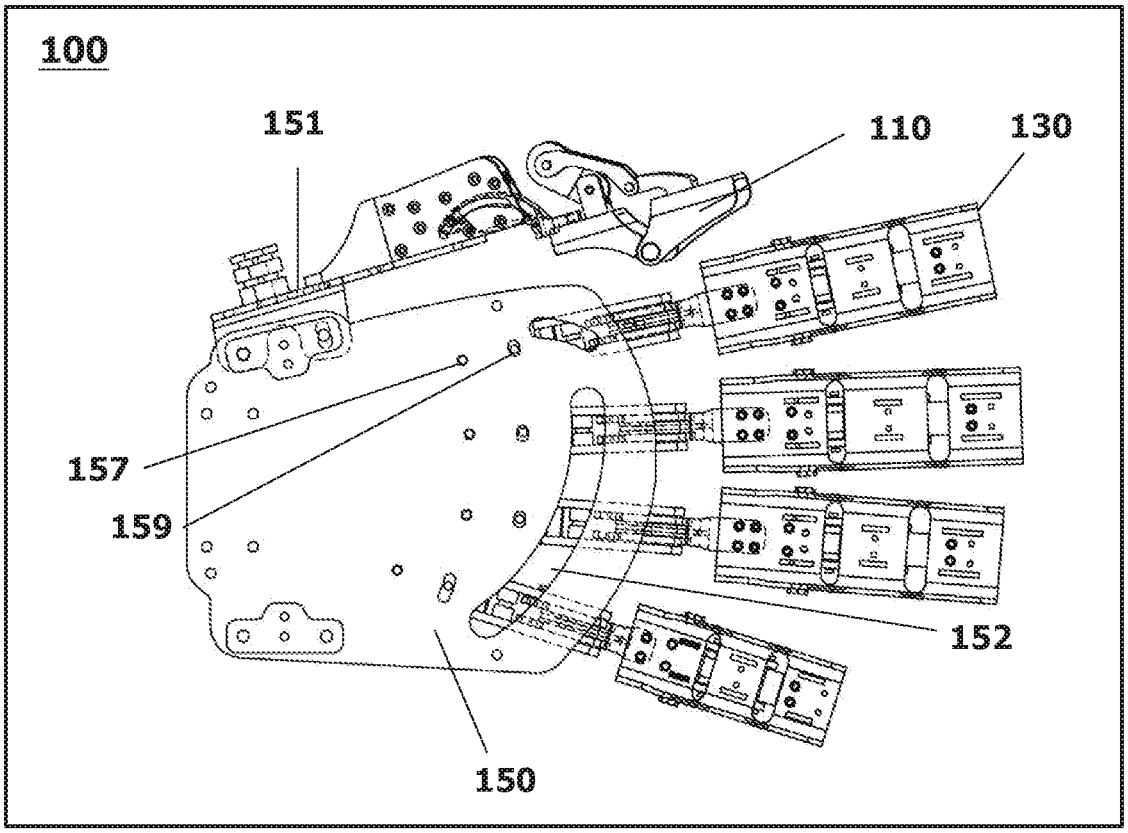
FIG. 3B is a top view of illustrating a palm joint mechanism of a wearable hand rehabilitation system in accordance with the present invention.
Figure 3C:
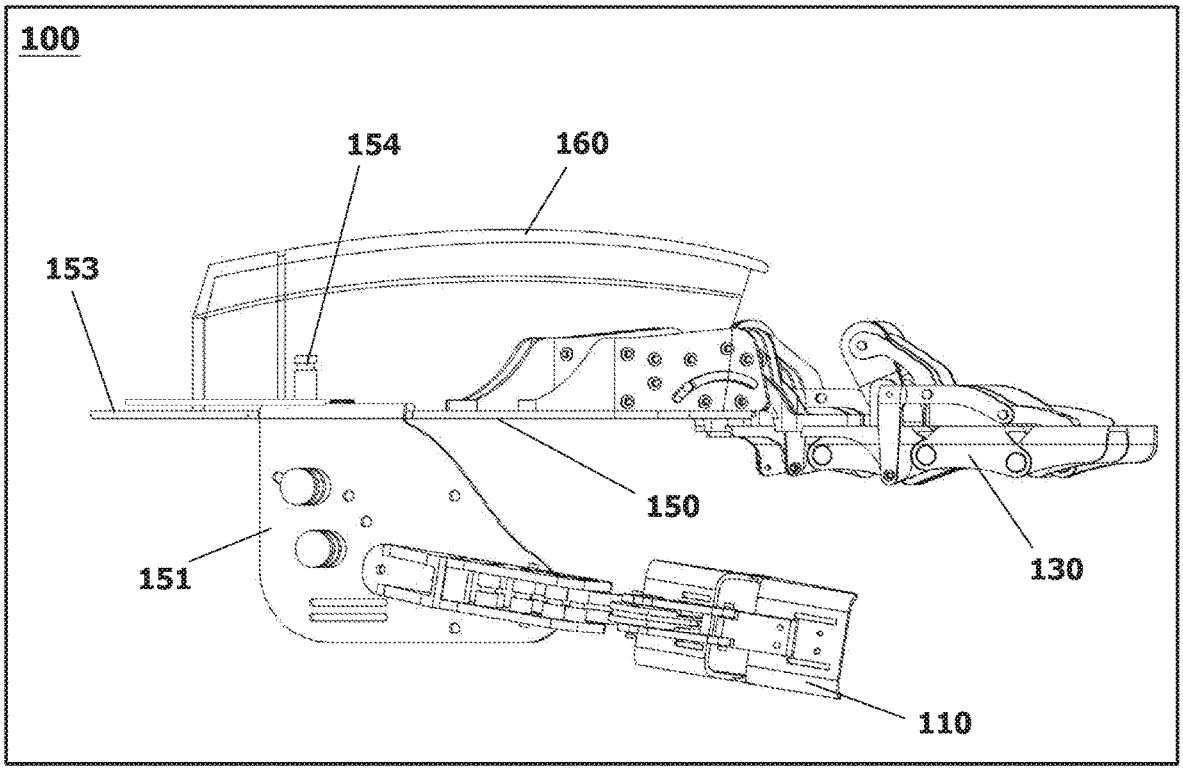
FIG. 3C is a side view of illustrating a palm joint mechanism of a wearable hand rehabilitation system in accordance with the present invention.

FIG. 1 is a systematic diagram of illustrating a wearable hand rehabilitation system in accordance with the present invention. As shown in FIG. 1, a wearable hand rehabilitation system 10 includes: a base 11, a hand assistive unit 100 (as shown in FIG. 3A-3B), a driving unit 200, a tension sensing unit 300, a transmission cable 400 and a control unit 500. The hand assistive unit 100 includes a thumb joint mechanism 110, four finger joint mechanisms 130 and a palm base 150. It should be illustrate that the four finger joint mechanisms 130 or a plurality of finger joint mechanisms 130 can be regarded as the same component in this invention. The hand assistive unit 100 is coupled to the detachable base 11, and the tension sensing unit 300 is adjacently arranged behind the hand assistive unit 100. A plurality of elastic sensing rods (as shown in FIG. 3C) are arranged inside the hand assistive unit 100 and it can communicate with the control unit 500 in a wired or wireless way. Moreover, as shown in FIG. 1, the wearable hand rehabilitation system 10 of the present invention is coupled to the hand assistive unit 100, the tension sensing unit 300, and the driving unit 200 with a plurality of transmission cables 400. Thus, the driving unit 200 is launched by commands of the control unit 500 to control the plurality of transmission cables 400 in accordance with torque and angle commands, and the thumb joint mechanism 110 or the four finger joint mechanisms 130 on the hand assistive unit 100 is further driven by the transmission cables 400 to bend. Consequently, user's fingers are driven to bend along with the bending of the thumb joint mechanism 110 and of the finger joint mechanisms 130. Furthermore, the control unit 500 may communicate with the driving unit 200 in a wired or wireless way. At same time, both torque of the driving unit 200 and feedback force of user's fingers acting on the driving unit 200 are detected by the transmission cables 400 and the tension sensing unit 300. Next, the hand assistive unit 100 includes a thumb joint mechanism 110 and the plurality of finger joint mechanisms 130.

Figure 2A:
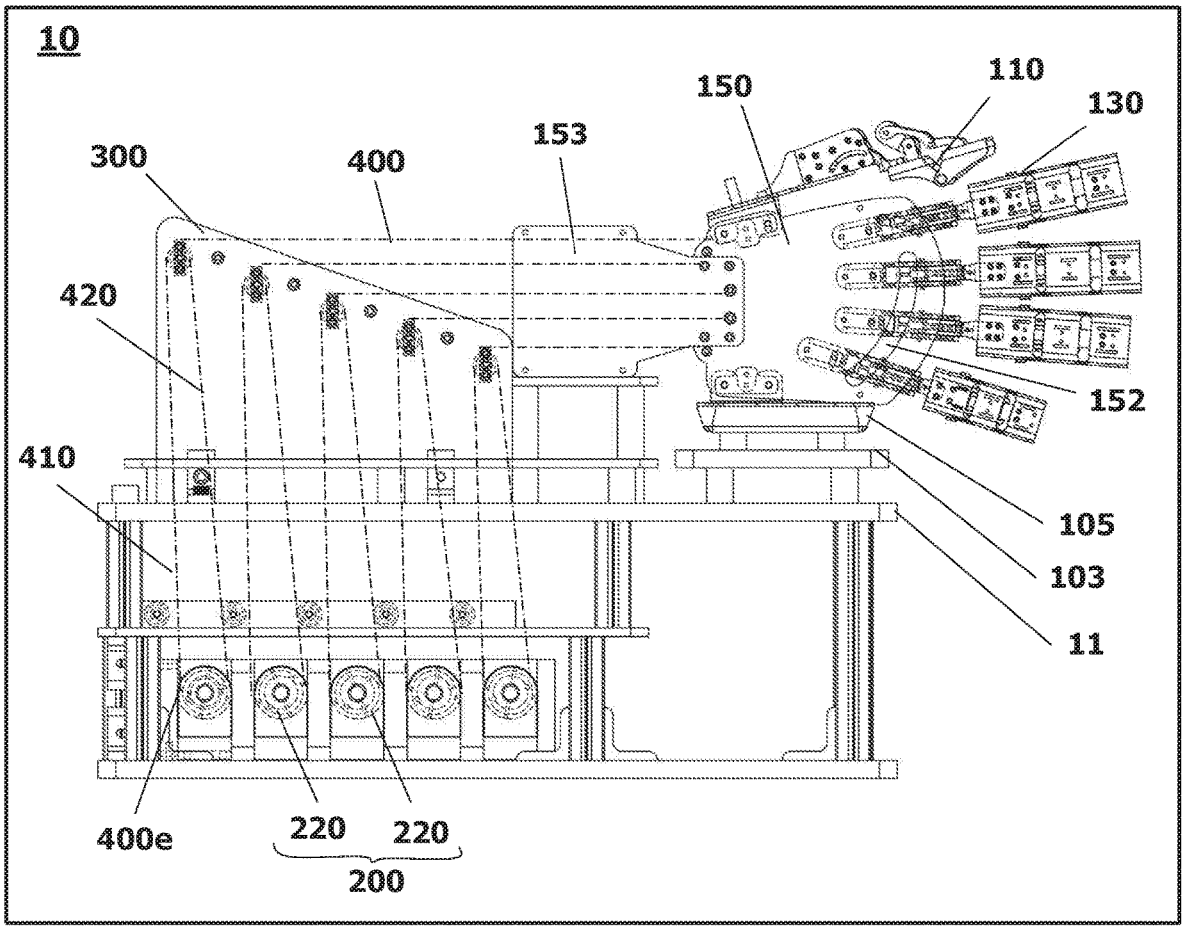
FIG. 2A is a side view of illustrating a wearable hand rehabilitation system in accordance with the present invention.

FIG. 2A is a side view of illustrating a wearable hand rehabilitation system in accordance with the present invention. As shown in FIG. 2A, the wearable hand rehabilitation system 10 of the present invention includes a detachable base 11 equipped with a support plate 101 for supporting the user's arm. Preferably, the support plate 101 is symmetrically arranged onto the base 11. Besides, the hand assistive unit 100 (as shown in FIG. 3A) is fixed onto a base-fixing seat 103 on the base 11 and a palm-fixing seat 105. Next, the hand assistive unit 100 and the tension sensing unit 300 are positioned at one side of the support plate 101 on the base 11. That is, both the hand assistive unit 100 and the tension sensing unit 300 protrude out of the support plate 101.

Please also refer to FIG. 2A, the hand assistive unit 100 includes a thumb joint mechanism 110, the plurality of finger joint mechanisms 130 (also called as the four finger joint mechanisms in this invention) and the palm base 150. The thumb joint mechanism 110 and the plurality of finger joint mechanisms 130 are respectively fixed onto one end of the palm base 150. The plurality of finger joint mechanisms 130 includes ones corresponding to human index finger, middle finger, ring finger and pinky finger. It is noted that the thumb joint mechanism 110 and the plurality of finger joint mechanisms 130 are positioned at different planes. For example, an angle between the thumb joint mechanism 110 and the plurality of finger joint mechanisms 130 is close to 90 degrees. Besides, the palm base 150 is coupled to a detachable fix mechanism 153 with one end and to the base-fixing seat 103 with another end by the palm-fixing seat 105. Thus, the hand assistive unit 100 may couple to the detachable base 11 by the base-fixing seat 103.

Continuing reference to FIG. 2A, the hand assistive unit 100 (as shown in FIG. 3A) and the tension sensing unit 300 are positioned above both the base 11 and the support plate 101, and the driving unit 200 is constituted by a plurality of motors 220 that is positioned beneath both the base 11 and the support plate 101. Next, the hand assistive unit 100 includes the thumb joint mechanism 110, the four finger joint mechanisms 130 and the palm base 150. The thumb joint mechanism 110 and four finger joint mechanisms 130 are respectively fixed onto one end of the palm base 150. It is noted that the thumb joint mechanism 110 and four finger joint mechanisms 130 are positioned at different planes. Besides, the palm base 150 is coupled to a detachable fix mechanism 153 with one end so as to couple the hand assistive unit 100 and the detachable base 11. Moreover, a through slot 152 is formed on the palm base 150 which may be able to check whether the user's fingers are in the right place when wearing the hand assistive unit 100.

The driving unit 200 is constructed by five motors 220, and the driving unit 200 is positioned beneath both the base 11 and the support plate 101. Obviously, five motors 220 respectively are corresponding to the thumb joint mechanism 110 and four finger joint mechanisms 130. Each motors 220 is equipped with an encoder as well as a decoder for receiving the commands from the control unit 500 to drive each motor 220 and for both encoding motor position and transmitting it back to the control unit 500. Besides, in examples of the present invention, the plurality of transmission cables 400 are grouped into five sets of transmission cables to correspond to the thumb joint mechanism 110 and the four finger joint mechanisms 130. And the each set of transmission cables 400 includes bending-end transmission cables 420 and straighten-end transmission cables 410. In one embodiment, one pair of the bending-end transmission cable 420 and the straighten-end transmission cable 410 is fixed, with their respective one end, onto the thumb joint mechanism 110 and the four finger joint mechanisms 130 of the hand assistive unit 100, and is fixed with their respective another end to the motor 220. The thumb joint mechanism 110 and the four finger joint mechanisms 130 may be stably pulled by one pair of the bending-end transmission cable 420 and the straighten-end transmission cable 410. For example, in the case of the bending-end transmission cable 420 and the straighten-end transmission cable 410 being fixed with one end to the four finger joint mechanisms 130, when the motor 220 is in counterclockwise rotation, the bending-end transmission cable 420 can be pulled and the straighten-end transmission cable 410 can be released at same time. Besides, in the wearable hand rehabilitation system of the present invention, each finger is connected to the tension sensing unit 300 and the driving unit 200 through the pair of transmission cables 400, so that the control unit 500 can independently assist the patient to do rehabilitation of each finger.

According to above illustration, the hand assistive unit 100, the tension sensing unit 300 and the driving unit 200 are connected by the five pairs of transmission cables 400 in the wearable hand rehabilitation system 10 of the present invention. When a patient needs finger rehabilitation, after the patient wearing the hand assistive unit 100, the driving unit 200 can be driven by the motion commands from the control unit 500 to release and pull the bending-end transmission cable 420 in the transmission cable 400 accordingly. Moreover, either the thumb joint mechanism 110 or the four finger joint mechanisms 130 on the hand assistive unit 100 is driven by the bending-end transmission cable 420 to bend and further enables the patient's finger to bend along with the mechanisms. Besides, the feedback force from the patient's finger in bending motion, which is in response to the commands of the driving unit 200, can be detected by the transmission cable 400 and the tension sensing unit 300, and resistance force from the patient's finger may be determined according to tension measured by the tension sensing component. That is to say, the feedback force is detected out by the bending-end transmission cable 420 in the transmission cables 400. It is obvious that a tension value of the bending-end transmission cable 420 is measured by the tension sensing unit 300 and transmitted to the control unit 500 for analysis and utilization in evaluating situation of the patient's finger.

Figure 2B:
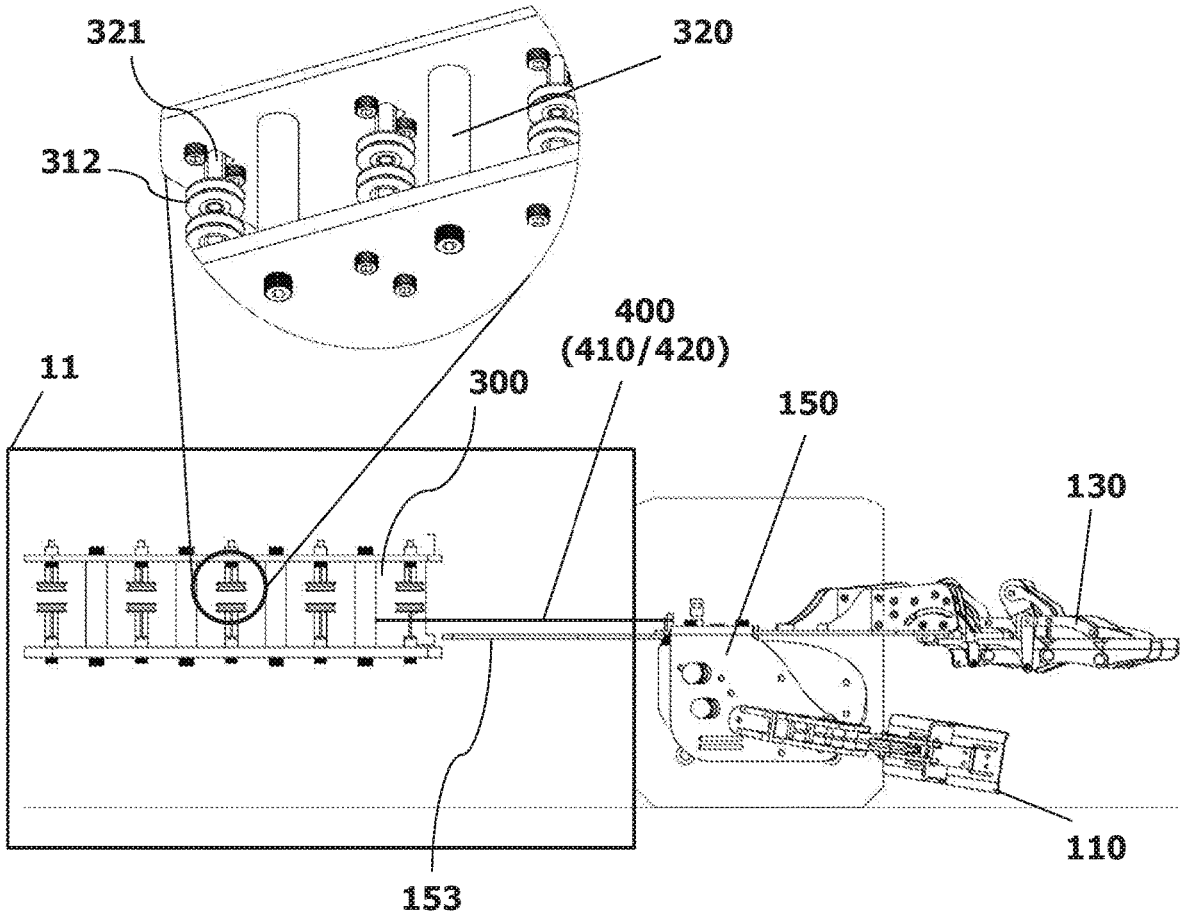
FIG. 2B is a top view of illustrating a wearable hand rehabilitation system in accordance with the present invention.
Figure 5:
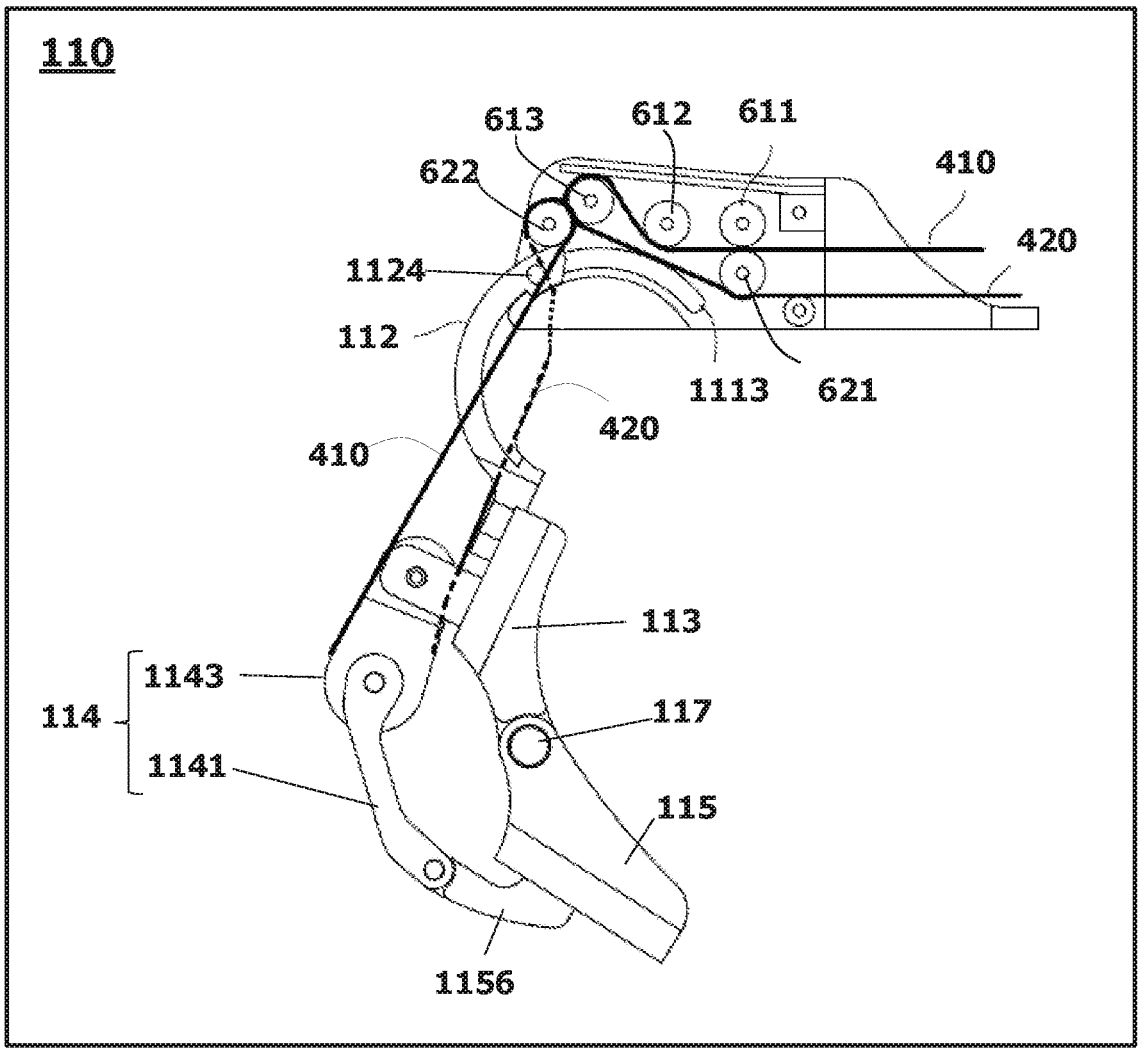
FIG. 5 is a schematic of illustrating a bending of a thumb joint mechanism of a wearable hand rehabilitation system in accordance with the present invention.

Next, FIG. 2B is a top view of illustrating a wearable hand rehabilitation system in accordance with the present invention. As shown in FIG. 2B, the hand assistive unit 100 on the wearable hand rehabilitation system 10 of the present invention includes the thumb joint mechanism 110, the plurality of finger joint mechanisms 130 and the palm base 150. The tension sensing unit 300 is positioned behind the hand assistive unit 100. The palm base 150 may couple to the hand assistive unit 100 and the base 11 through the detachable fix mechanism 153. Next, from the FIG. 2B, the five pairs of the transmission cables 400 is connecting the thumb joint mechanism 110 and the plurality of finger joint mechanisms 130 which are guided into the palm base 150 for collection and further connected to the five sets of the elastic sensing rods 321. Besides, please refer to a zoom-in block in FIG. 2B, the plurality of fix rods 320 in the tension sensing unit 300 are provided to set a distance of two sides of the tension sensing unit 300. And there are five sets of elastic sensing rods 321 spaced apart and in pairs between the plurality of fix rods 320. Furthermore, please refer to FIG. 2B, FIG. 5 and FIG. 6C. The bending-end transmission cable 420 and the straighten-end transmission cable 410 in the transmission cables 400 respectively contact the elastic sensing rods 321 in the tension sensing unit 300. The five sets of the bending-end transmission cables 420 and the straighten-end transmission cables 410 respectively correspond to five fingers. One end of each bending-end transmission cable 420 and one end of each straighten-end transmission cable 410 are connected to the driving shafts 114, 134 of five fingers (as shown in FIG. 5 and FIG. 6C), passing through the palm base 150 to connect to the plurality of sets of the elastic sensing rods 321 on the tension sensing unit 300. The other ends of each bending-end transmission cable 420 and each straighten-end transmission cable 410 are pulled down to connect to its corresponding motor 220. Obviously, the five pairs of elastic sensing rods 321 disposed in the tension sensing unit 300 are corresponding to the five pairs of transmission cables 400 of the bending-end transmission wire 420 and the straighten-end transmission wire 410 respectively, and the tension sensing unit 300 is provided for detecting the tension of the transmission cables 400. The data of the measured tension values are transmitted to the control unit 500 for analysis and evaluation of situation of the patient's fingers.

Moreover, a predetermined value may be set by the control unit 500. When the tension value of the thumb or the fingers (the fingers includes index finger, middle finger, ring finger and pinky finger) is over the predetermined value, the wearable hand rehabilitation system 10 would stop acting under the commands of the control unit 500 to prevent the patient from being injured. The predetermined value can be changed/adjusted according to different patients' situation by a doctor/medical personnel.

FIG. 3A is an overlooking diagram of illustrating a hand assistive unit of a wearable hand rehabilitation system in accordance with the present invention. As shown in FIG. 3A, the hand assistive unit 100 includes the thumb joint mechanism 110, the four finger joint mechanisms 130 and the palm base 150. The thumb joint mechanism 110 and the four finger joint mechanisms 130 are respectively fixed onto one end of the palm base 150. The thumb joint mechanism 110 is connected to the palm base 150 with a joint connecting part 151 to form an L-shaped like structure so as to enable the thumb joint mechanism 110 and the plurality of finger joint mechanisms 130 to be fixed at different planes for consideration of hand anatomy, including the thumb, index finger, middle finger, ring finger and pinky finger. That the thumb joint mechanism 110 and the four finger joint mechanisms 130 are respectively fixed onto the L-shaped like structure formed by the palm base 150 and the thumb joint connecting part 151 can enable the patient's thumb to bend freely. Besides, the L-shaped like structure formed by the palm base 150 and the joint connecting part 151 not only make the patient's five fingers (thumb, index finger, middle finger, ring finger and pinky finger) easy to wear the hand assistive unit 100 but also prevent the thumb joint mechanism 110 from interfering the four finger joint mechanisms 130 in bending.

Please refer to FIG. 3A continuously, a plurality of wire concentrator rods 154 are arranged at one side of the palm base 150 and the detachable fix mechanism 153 shown in FIG. 2A, and are configured to attach to the five pairs of the transmission cables 400 on the five finger joint mechanisms of same level (including the thumb joint mechanism 110 and the four finger joint mechanisms 130). It is of course that the five pairs of the transmission cables 400 are guided into the wire concentrator rods 154 on the palm base 150 for cable collection. Besides, the L-shaped like structure formed by the thumb joint connecting part 151 and the palm base 150 enable the thumb joint connecting part 151 and the palm base 150 to be arranged at different levels. Consequently, the plurality of wire concentrator rods 154 are arranged on the thumb joint connecting part 151 to guide the transmission cables 400 of the thumb joint mechanism 110. Furthermore, please refer to FIG. 2B again, in one embodiment, the five wire concentrator rods 154 are used to correspond to the five pairs of the elastic sensing rods 321 in the tension sensing unit 300. Preferably, there is a recess 155 formed at the top end of each wire concentrator rod 154, so that the transmission cables 400 are easy to be fixed with the recess 155.

FIG. 3B is a top view of illustrating a hand assistive unit of a wearable hand rehabilitation system in accordance with the present invention. As shown in FIG. 3B, a plurality pairs of fixing holes 157, 159 are arranged on the palm base 150. The pair of fixing holes 159 may be a slot structure and are used to make fine tuning of left angle and/or right angle for four fingers when the four fingers are connected to the palm base 150. For example, the thumb joint mechanism 110 and each of finger joint mechanisms 130 are coupled onto the palm base 150 via these fixing holes 157, 159. Customerization may be achieved because each pairs of the fixing holes 157, 159 are designable in various slot structure, distance and angles, depending on the patient's fingers sizes and distribution, as well as the wearing comfortability may be improved as the device is applied on the patient's hand. It is noted that how to fix with the fixing holes 157, 159 is not limited and may be adjusted depending to material of the palm base 150.

FIG. 3C is a side view of illustrating a hand assistive unit of a wearable hand rehabilitation system in accordance with the present invention. As shown in FIG. 3C, the detachable fix mechanism 153 is positioned on one end of the palm base 150, and the other end of the palm base 150 is linked to the base-fixing seat 103 via the palm-fixing seat 105 (as shown in FIG. 2A). Thus, the hand assistive unit 100 (as shown in FIG. 3A) may be coupled to the detachable base 11 via the base-fixing seat 103. The palm base 150 couples to the thumb joint mechanism 110 and the plurality of finger joint mechanisms 130. Besides, the plurality of wire concentrator rods 154 are arranged on one end of the palm base 150 that is close to the detachable fix mechanism 153. Next, a housing 160 used to cover the palm base 150 is mainly configured to protect the plurality of transmission cables 400 from being contacted by the patient during hand rehabilitation to result in error on the detection of tension.

Figure 4A:
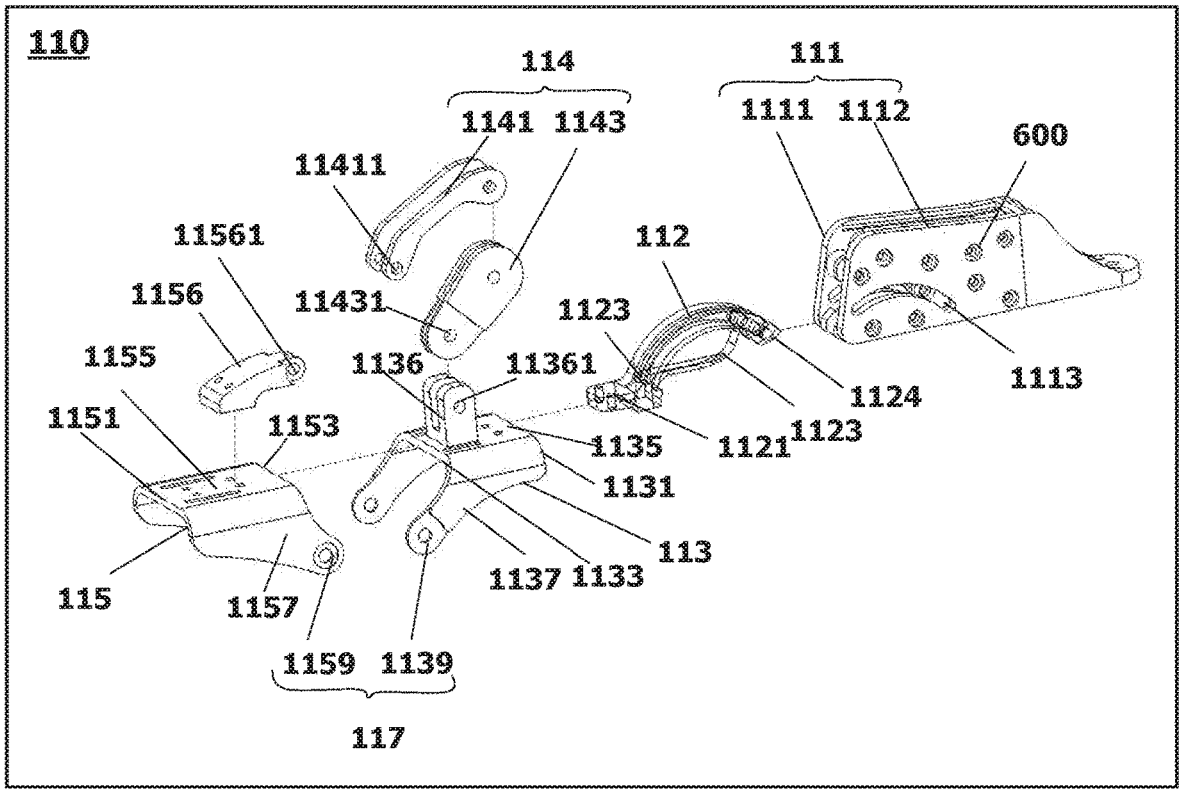
FIG. 4A is an explosive view of illustrating a thumb joint mechanism of a wearable hand rehabilitation system in accordance with the present invention.

FIG. 4A is an explosive view of illustrating a thumb joint mechanism of a wearable hand rehabilitation system in accordance with the present invention. As shown in FIG. 4A, the thumb joint mechanism 110 of the present invention includes the thumb metacarpophalangeal joint 111, the thumb proximal joint 113, the thumb driving shaft 114 and the thumb distal joint 115. The thumb metacarpophalangeal joint 111 may be a structure having an accommodation space to accommodate a thumb slide linking bar 112. The accommodation space may be defined and formed by at least one pair of sidewalls 1111, 1112, and a pulley set 600 including a plurality of cable pulleys may be arranged at one of the sidewalls (such as the sidewall 1112). The pulley set 600 including the plurality of cable pulleys may pairly contact the transmission cables 400 and be used as move rails for the transmission cables 400. Moreover, the pair of the sidewalls 1111, 1112 of the thumb metacarpophalangeal joint 111 includes a pair of thumb slides 1113. In one preferred embodiment, the thumb slide 1113 is an arc slide slot and is optionally arranged among the cable pulleys of the pulley set 600. Besides, the thumb slide linking bar 112 may be accommodated within the accommodation space of the thumb metacarpophalangeal joint 111. One end 1121 of the thumb slide linking bar 112 is coupled to a top end 1135 of the thumb proximal phalanx 113, and another end of the thumb slide linking bar 112 is provided with a thumb slide latch 1124 thereon. When the thumb slide linking bar 112 is arranged within the accommodation space of the thumb metacarpophalangeal joint 111 and the thumb slide latch 1124 is pivotally connected within the thumb slide 1113, the thumb slide linking bar 112 may move among the thumb slides 1113 because of the pivoting of the thumb slide latch 1124 and the pulling of the transmission cable 400. It is noted that the arrangement of the pulley set 600 in the thumb metacarpophalangeal joint 111 may help keep the pathway of the transmission cable 400 stable.

Please still refer to FIG. 4A, the thumb proximal phalanx 113 has two open ends 1131, 1133 and a top end 1135. The top end 1135 is coupled to one end 1121 of the thumb slide linking bar 112. The open end 1133 includes two sides 1137 coupled to the two ends of the top end 1135. The each sides 1137 has an open end that is outward and downward a distance with respect to the top end 1135, and a pivot hole 1139 is arranged on the open end of the each sides 1137. In one embodiment, the top end 1135 has a width, a top surface of the top end 1135 is provided with a link end 1136 protruding upward, and a pivot hole 11361 is formed on the open end of the link end 1136. The width of the top end 1135 and the outward and downward extending a distance of the two sides 1137 may be designed for the user's thumb size.

Please also refer to FIG. 4A, the thumb distal joint 115 is also provided with two open ends 1151, 1153 and a top end 1155. The open end 1153 adjacent to the thumb proximal joint 113 has two sides 1157 coupled to two ends of the top end 1155. The each sides 1157 has an open end that is outward and downward extending a distance with respect to the top end 1155 and a pivot hole 1159 is arranged on the open end of the each sides 1157. It is noted that the pivot hole 1159 on the thumb distal joint 115 is correspondingly pivotally connected to the pivot hole 1139 of the thumb proximal joint 113. The pivoting of the pivot hole 1159 and the pivot hole 1139 may form a movable thumb interphalangeal joint 117. Moreover, the other end 1151 opposite to one end 1153 of the thumb distal phalanx 115 is an open terminal. Next, an upwardly protruded link end 1156 is formed on a top surface of the top end 1155 of the thumb distal joint 115, and a pivot hole 11561 is arranged at the open end of the link end 1156.

Please refer to FIG. 4A again, the thumb driving shaft 114 is formed by pivoting a first link part 1141 and a second link part 1143. There are pivot holes arranged on the two open ends of the first link part 1141 and the second link part 1143. The connection of the pivot holes on the open ends of the first link part 1141 and the second link part 1143 may form one piece body with a pivot shaft to freely move with respect to the pivot shaft. Next, the pivot hole (not shown) on the open end 11411 of the first link part 1141 may be pivotally connected to the pivot hole 11561 of the link end 1156 on the thumb distal joint 115, and the pivot hole on the open end 11431 of the second link part 1143 may be pivotally connected to the pivot hole 11361 on the link end 1136 of the thumb proximal joint 113, so that these pivot connections aforementioned may make the thumb proximal joint 113 into one piece body. Consequently, when the first link part 1141 and the second link part 1143 of the thumb driving shaft 114 are driven to act the thumb proximal joint 113 and the thumb distal joint 115 may be driven by them to move together with them. In a preferred embodiment, the first link part 1141 may be an arm structure and the size of the second link part 1143 is bigger than that of the first link part 1141. It is noted that the shapes, the structures or the material of the first link part 1141 and the second link part 1143 are not limited to ones shown in the drawings of the present invention.

Figure 4B:
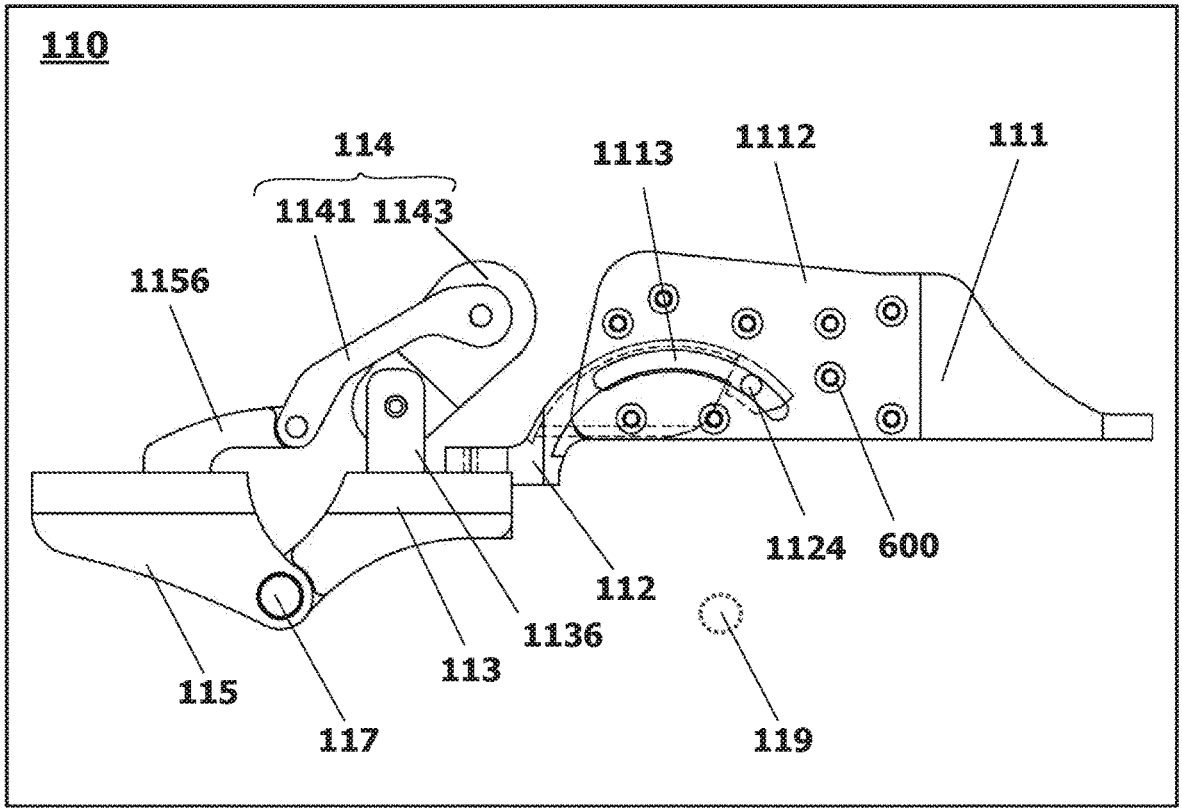
FIG. 4B is a combination view of illustrating a thumb joint mechanism of a wearable hand rehabilitation system in accordance with the present invention.

FIG. 4B is a combination view of illustrating a thumb joint mechanism of a wearable hand rehabilitation system in accordance with the present invention. As shown in FIG. 4B, when the thumb joint mechanism 110 is assembled together, a virtual center point 119 that is equal to an intersection of two normal lines with respect to two terminals of the thumb slide 1113 would form. This virtual center point 119 and the thumb interphalangeal joint 117 could be kept on a baseline. Moreover, the virtual center point 119 may be a reference point for the thumb proximal joint 113 in bending. Furthermore, the thumb interphalangeal joint 117 is used as a rotation center for the thumb distal phalanx 115 in bending, and equal to the joint part of the pivot hole 1139 and the pivot hole 1159 in FIG. 4A. The position of the virtual center point 119 may be determined according to user's palm size and the shape and adjusted by adjusting the arc of the thumb slide 1113. With the design of the virtual center point 119, the user's palm may do rehabilitation with the thumb joint mechanism without interference, such as the muscle of the user's palm would not be sandwiched by the thumb joint mechanism in acting. Accordingly, when the thumb driving shaft 114 is driven by the transmission cables 400, the transmission cables 400 drive the thumb slide linking bar 112 to move between the two terminals of the thumb slide 1113 for driving the bending of the thumb proximal joint 113. Once the movement of the thumb slide linking bar 112 reaches to the one terminal of the thumb slide 1113, the thumb proximal joint 113 would stop bending. Next, the thumb distal joint 115 would bend by utilizing the thumb interphalangeal joint 117 as a rotation center, and the max bending angle is right angle. Such an operation and action will be illustrated with the following paragraphs.

Next, FIG. 5 is a schematic of illustrating a bending of thumb metacarpophalangeal joint of a wearable hand rehabilitation system in accordance with the present invention. As shown in FIG. 5, the pulley set 600 including the plurality of cable pulleys is arranged on the sidewall 1111 of the thumb joint mechanism 110 and is used as a moving track for the transmission cable 400. In the present invention, the transmission cable 400 includes two independent cables: the straighten-end transmission cable 410 to drag finger for straightening fingers and the bending-end transmission cable 420 to drag finger for the bending fingers. The pulley set 600 includes a first pulley set 611, 612, 613 and a second pulley set 621, 622 for contacting the straighten-end transmission cable 410 and the bending-end transmission cable 420. The first pulley set 611, 612, and 613 contacts the straighten-end transmission cable 410, and the second pulley set 621, 622 contacts the bending-end transmission cable 420. With respective one end, the straighten-end transmission cable 410 and the bending-end transmission cable 420 are coupled to different positions of same motor 220; and with respective the other end, the straighten-end transmission cable 410 and the bending-end transmission cable 420 are fixed onto same or different positions of the second link part 1143 of the thumb driving shaft 114. Because the second link part 1143 of the thumb driving shaft 114 in the present invention could be acquired by assembling, the interior of the second link part 1143 could be a hollow structure or a partial hollow structure, so that one or more turntables (not shown) may be arranged for fixing the ends of the straighten-end transmission cable 410 and the bending-end transmission cable 420. It is noted that a displacement distance may be set by the arrangement of the turntables with various sizes. When the second link part 1143 of the thumb driving shaft 114 is driven in the rehabilitation assistive system 10, the straighten-end transmission cable 410 contacts the first pulley set 611, 612, 613 and the pulley 622, and the bending-end transmission cable 420 passes through the thumb slide linking bar 112 first and then contacts a thumb slide latch 1124 and the second pulley set 621, 622. The straighten-end transmission cable 410 and the bending-end transmission cable 420 may slide smoothly within the second link part 1143 by the guiding of the one or more turntables.

When the motor 220 rotates in counterclockwise direction, both the bending-end transmission cable 420 and the straighten-end transmission cable 410 are driven to rotate in counterclockwise direction. At this moment, the thumb slide linking bar 112 of the thumb metacarpophalangeal joint 111 would be driven by the bending-end transmission cable 420 to move along the thumb slide 1113. The thumb slide linking bar 112 will stop bending when it reaches to one terminal of the thumb slide 1113. Next, the second link part 1143 of the thumb driving shaft 114 will be continuously driven by the bending-end transmission cable 420 and the straighten-end transmission cable 410 to rotate in counterclockwise direction. And the first link part 1141 is then driven to drive the thumb distal joint 115 to bend with the thumb interphalangeal joint 117 as a rotation center.

Obviously, in a preferred embodiment of the present invention, the arrangement of contacting the straighten-end transmission cable 410 and the bending-end transmission cable 420 respectively with the first pulley set 611, 612, 613 and the second pulley set 621, 622 not only keeps the straighten-end transmission cable 410 and the bending-end transmission cable 420 in a tensional state but also prevents the straighten-end transmission cable 410 and the bending-end transmission cable 420 from twisting during the operation. For example, when the first pulley set 611, 612, and 613 contacts the straighten-end transmission cable 410, the straighten-end transmission cable 410 can contact one end of the pulley 611 and the pulley 612. Next, the straighten-end transmission cable 410 can pass around the pulley 613 and then contact another end of the pulley 613 to form a S-type staggered contact at the pulley 612 and the pulley 613. Next, the straighten-end transmission cable 410 can pass around the pulley 622 and then contact another end of the pulley 622 to form a S-type staggered contact at the pulley 622 and the pulley 613, too. Finally, the straighten-end transmission cable 410 is fixed onto the turntable in the interior of the second link part 1143. Similarly, when the second pulley set 621/622 contacts the bending-end transmission cable 420, the bending-end transmission cable 420 can contact one end of the pulley 621 first, and then the bending-end transmission cable 420 can pass around and contact another end of the pulley 622 to form S-type staggered contact with the pulley 621. Next, after passing around the thumb slide latch 1124, the bending-end transmission cable 420 passes through the thumb slide linking bar 112 and then is fixed to the turntable of the interior of the second link part 1143.

The thumb metacarpophalangeal joint 111 is provided with two sidewalls 1111, 1112 and an accommodation space between the sidewalls 1111, 1112 for accommodating the thumb slide linking rod 112. The pulley set 600 may optionally be fixed within the accommodation space between the sidewalls 1111, 1112. The sidewalls 1111, 1112 can be combined together into a piece with plural fixing screws (not shown). Furthermore, a pair of through holes 1123 is arranged on two ends of a bottom plate of the thumb slide linking bar 112. The bending-end transmission cable 420 could pass through the through holes 1123 to form contacts of the bending-end transmission cable 420 and the thumb slide linking bar 112. When the bending-end transmission cable 420 is driven, the thumb slide linking bar 112 is further driven by the bending-end transmission cable 420 to move between the two terminals of the thumb slide linking bar 112.

It is noted that the pulley set 600 in the present invention is used as a moving track of the transmission cable 400 for the driven transmission cable 400 in bending. However, it is an example for illustration of the present invention and is not limited to how many pulleys for contacting the transmission cable 400 are used and how to make the transmission cable 400 and each pulley contact. Moreover, in order to precisely acquire the tension data on the straighten-end transmission cable 410 and the bending-end transmission cable 420, the straighten-end transmission cable 410 and the bending-end transmission cable 420 are made of metal cables, especially the ones with a diameter between/in the range of 0.5 mm~1 mm. It is also understood that the present invention is not limited to what kinds of metal cable.

Continuing reference to FIG. 5, the cable pulley set 600 including the plurality of cable pulleys is equipped onto the sidewall 1111 of the thumb metacarpophalangeal joint 111 and is used as a moving track of the transmission cable 400. In one embodiment of the present invention, the transmission cable 400 includes two independent cables: the straighten-end transmission cable 410 and the bending-end transmission cable 420. The cable pulley set 600 includes a first pulley set 611, 612, 613 and a second pulley set 621, 622 for contacting the straighten-end transmission cable 410 and the bending-end transmission cable 420. The straighten-end transmission cable 410 contacts the first pulley set 611, 612, and 613 and the pulley 622, and the bending-end transmission cable 420 at least contacts the second pulley set 621, 622.

The respective ends of the straighten-end transmission cable 410 and the bending-end transmission cable 420 are coupled to the different positions of the same motor 220, and the respective other ends of the straighten-end transmission cable 410 and the bending-end transmission cable 420 are respectively fixed onto the turntable in the interior of the thumb driving shaft 114. When the motor 220 rotates in counterclockwise direction, both the bending-end transmission cable 420 and the straighten-end transmission cable 410 are driven to move towards counterclockwise direction. The second link part 1143 of the finger driving shaft 114 is driven by the bending-end transmission cable 420 and the straighten-end transmission cable 410 to rotate towards counterclockwise direction. At this moment, the thumb slide linking bar 112 of the thumb metacarpophalangeal joint 111 is firstly driven by the bending-end transmission cable 420 to move along the thumb slide 1113. The thumb slide linking bar 112 will stop bending when it reaches to the terminal of the thumb slide 1113. Next, the bending-end transmission cable 420 and the straighten-end transmission cable 410 can continuously drive the second link part 1143 to enable the second link part 1143 to rotate and drive the first link part 1141, so that the thumb proximal phalanx 113 and the thumb distal phalanx 115 may be driven by the second link part 1143 and the first link part 1141 to bend. For example, in one embodiment of the present invention, the thumb distal joint 115 driven by the first link part 1141 may bend by taking the thumb interphalangeal joint 117 as a rotation center to reach max bending angle of 90 degrees shown in FIG. 5.

Figure 6A:
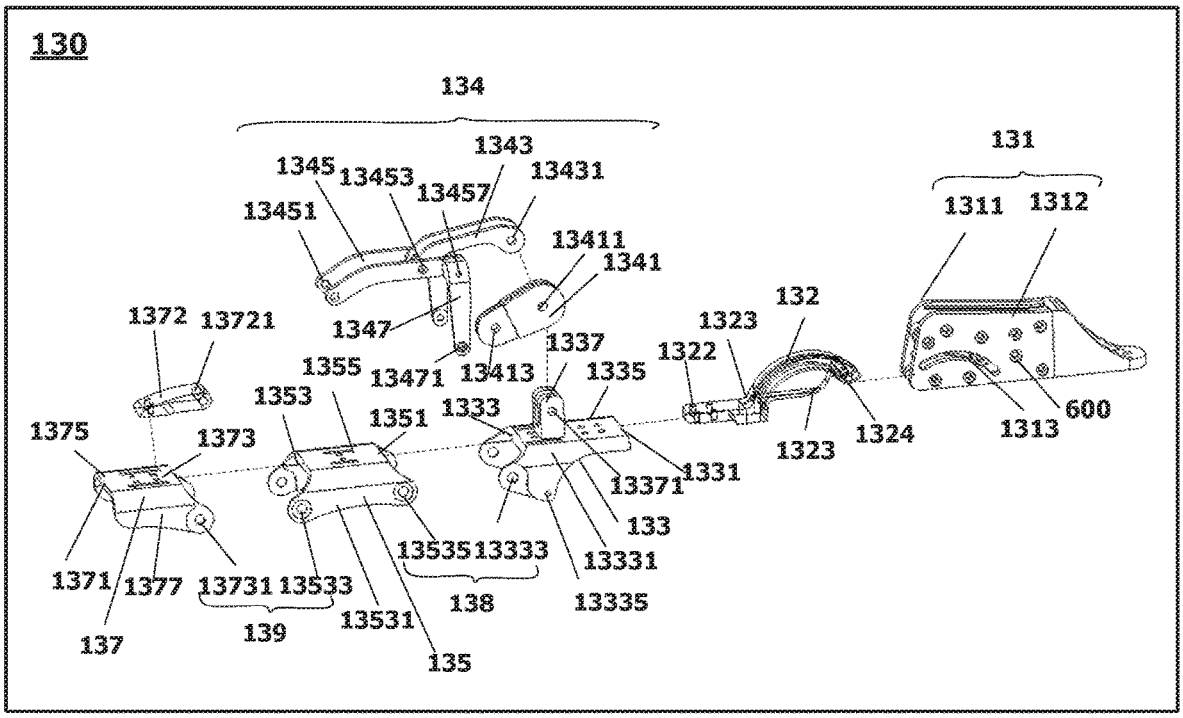
FIG. 6A is an explosive view of illustrating a finger joint mechanism of a wearable hand rehabilitation system in accordance with the present invention.

FIG. 6A is an explosive view of illustrating a finger joint mechanism of a wearable hand rehabilitation system in accordance with the present invention. As shown in FIG. 6A, the finger joint mechanism 130 of the present invention includes the finger metacarpophalangeal joint 131, the finger proximal phalanx 133, the finger driving shaft 134, the finger intermediate phalanx 135 and the finger proximal phalanx 137. Similar as the thumb metacarpophalangeal joint 111 in FIG. 4A, the finger metacarpophalangeal joint 131 is a structure with an accommodation space for accommodating the finger slide linking bar 132. The accommodation space is formed by at least a pair of sidewalls 1311, 1312, and the pulley set 600 including the plurality of cable pulleys is arranged onto the sidewall 1312. The pulley set 600 includes plural cable pulleys in-pair contacts the transmission cable 400 and is used as a moving track for the transmission cable 400. Moreover, a finger slide 1313 is positioned on the pair of the sidewalls 1311, 1312 of the finger metacarpophalangeal joint 131. In one preferred embodiment, the finger slide 1313 is an arc track slot and the pulley set 600 is optionally put into the finger slide 1313. Besides, the finger slide linking bar 132, which is put into the accommodation space of the finger metacarpophalangeal joint 131, has one end 1322 coupled to the top end 1335 of the finger proximal phalanx 133 and another end is with a finger slide latch 1324. When the finger slide linking bar 132 is put into the accommodation space of the finger metacarpophalangeal joint 131, the finger slide latch 1324 may be pivotally coupled within the finger slide 1313. With the pivotal connection of the finger slide latch 1324 and the pulling of the transmission cable 400, the finger slide linking bar 132 may move within the finger slide 1313. Furthermore, a pair of through holes 1323 is located at two ends of a bottom base of the finger slide linking bar 132. The bending-end transmission cable 420 may pass through the one/two through holes 1323 of the finger slide linking bar 132 and then connect the driving part 1341 of the finger driving shaft 134. It is noted that the arrangement of the pulley set 600 in the finger metacarpophalangeal joint 131 may keep the pathway of the transmission cable 400 stable.

Please still refer to FIG. 6A, the finger proximal joint 133 includes two open ends 1331, 1333 and a top end 1335. The top end 1335 is connected to the one end 1322 of the finger slide linking bar 132. The opposite open end 1333 has two sides 13331 coupled to the side ends of the top end 1335. The each sides 13331 has an open end that is outward and downward extending a distance with respect to the top end 1335 and a first pivot hole 13333 is arranged on the open end of the each side 13331. Moreover, a proximal assistive pivot hole 13335 is positioned next to the proximal pivot hole 13333 of the pair of the finger proximal sides 13331. In one embodiment, the top end 1335 has a width, and an upwardly protruded link end 1337 is formed on the top surface of the top end 1335. The width of the top end 1335 and the outward and downward extending distance of the two sides 13331 may be designed for the user's finger size.

Please refer to FIG. 6A again, the finger middle phalanx 135 includes two open ends 1351, 1353 and a top end 1355. The open end 1353 adjacent to the finger proximal joint 133 has the two sides 13531 connected to two ends of the top end, and a pair of middle terminal pivot holes 13535 are arranged on a terminal of the each finger middle sides 13531. These pair of pivot holes 13535 may couple to the proximal pivot hole 13333 of the finger proximal joint 133 to form a rotatable finger proximal interphalangeal joint (PIP) 138. The other open end 1353 of the finger middle phalanx 135 has the two side wings 13531 coupled to two ends of the top end 1355. And the pair of middle terminal pivot holes 13535 is arranged at start end of the each side wing 13531.

Please refer to FIG. 6A continuously, the finger proximal phalanx 137 is provided with two open ends 1371, 1373 and a top end 1375 and includes a pair of sides 1377 on the end 1373 adjacent to the finger intermediate phalanx 135. The pair of sides 1377 is coupled to two ends of the finger proximal top end 1375 and has an open end that is outward and downward extending a distance with respect to the top end 1375, and a pivot hole 13731 is arranged on the open end of the side wings 1377. That the pivot hole 13533 on the finger intermediate phalanx 135 is pivotally connected to the pivot hole 13731 on the finger proximal phalanx 137 and can form a movable a distal interphalangeal joint (DIP) 139. The end 1371 of the finger proximal phalanx 137 is an open terminal. Besides, a top surface of the top end 1375 of the finger proximal phalanx 137 includes a link end 1372, and a pair of pivot holes 13721 is formed on the terminal end of the protruding link end 1372.

Next, please refer to FIG. 6A again, the finger driving shaft 134 includes a driving part 1341, a first link arm 1343, a second link arm 1345 and a third link arm 1347. There are two open ends and a pair of pivot holes on each of the open ends for each of the driving part 1341, the first link arm 1343, the second link arm 1345 and the third link arm 1347. Thus, the pivot hole (now shown) on the one end of the first link arm 1343 is pivotally connected to the pivot hole 13453 which is on one end of the second link arm 1345 and adjacent to the first link arm 1343. The other pivot hole 13431 of the first link arm 1343 is connected to the pivot hole 13411 on one end of the driving part 1341. The other pivot hole 13413 of the driving part 1341 is connected to a pair of pivot holes 13371 on the link end 1337 of the finger proximal phalanx 133. A pair of pivot holes 13451 is positioned on one terminal of the other end of the second link arm 1345 and is configured to connect with the pivot holes 13721 on the link end 1372 of the finger proximal phalanx 137. Moreover, the second link arm 1345 further includes a pair of positioning pivot holes 13457 that is arranged on outside of one terminal where is adjacent to the connection of the first link arm 1343 and the second link arm 1345. Furthermore, a pair of pivot holes 13471 is positioned at one terminal of the one end of the third link arm 1347 and is configured to couple to the assistive pivot hole 13335 of the finger proximal phalanx 133. Next, the other end of the third link arm 1347 is pivotally connected to the positioning pivot hole 13457 of the second link arm 1345. It is noted that in the case of the finger joint mechanism 130 is completely assembled and keeps/remains in a straighten state, the angle between the third link arm 1347 and the second link arm 1345 is close to 90 degrees.

Figure 6B:
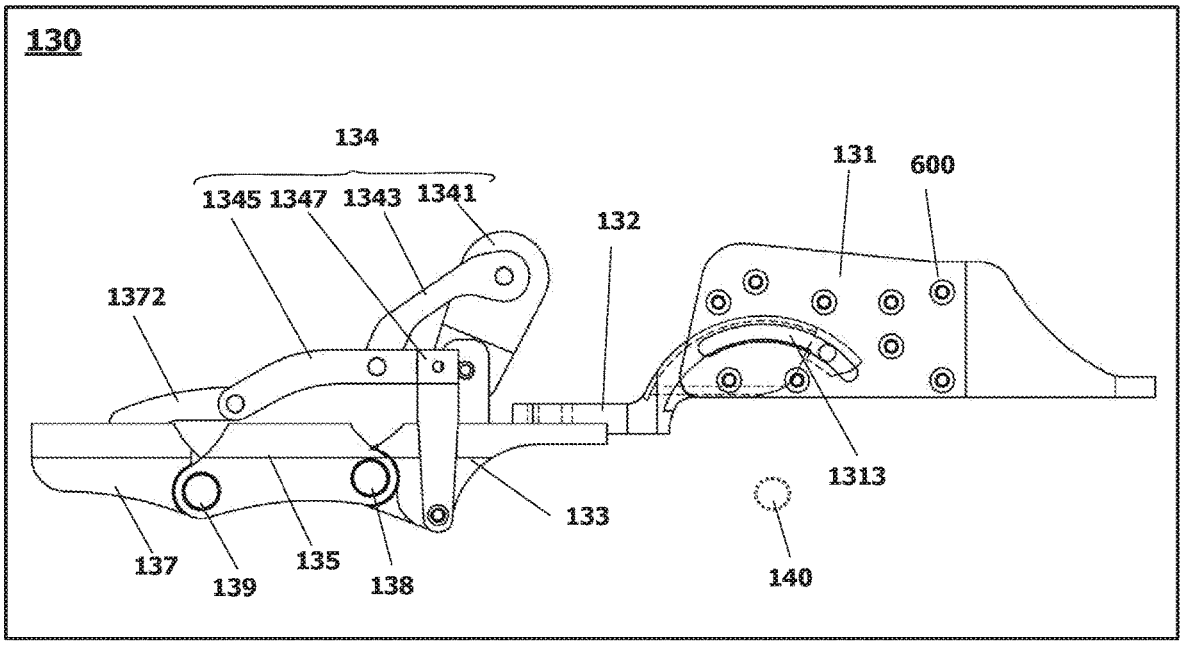
FIG. 6B is a combination view of illustrating a finger joint mechanism of a wearable hand rehabilitation system in accordance with the present invention.
Figure 6C:
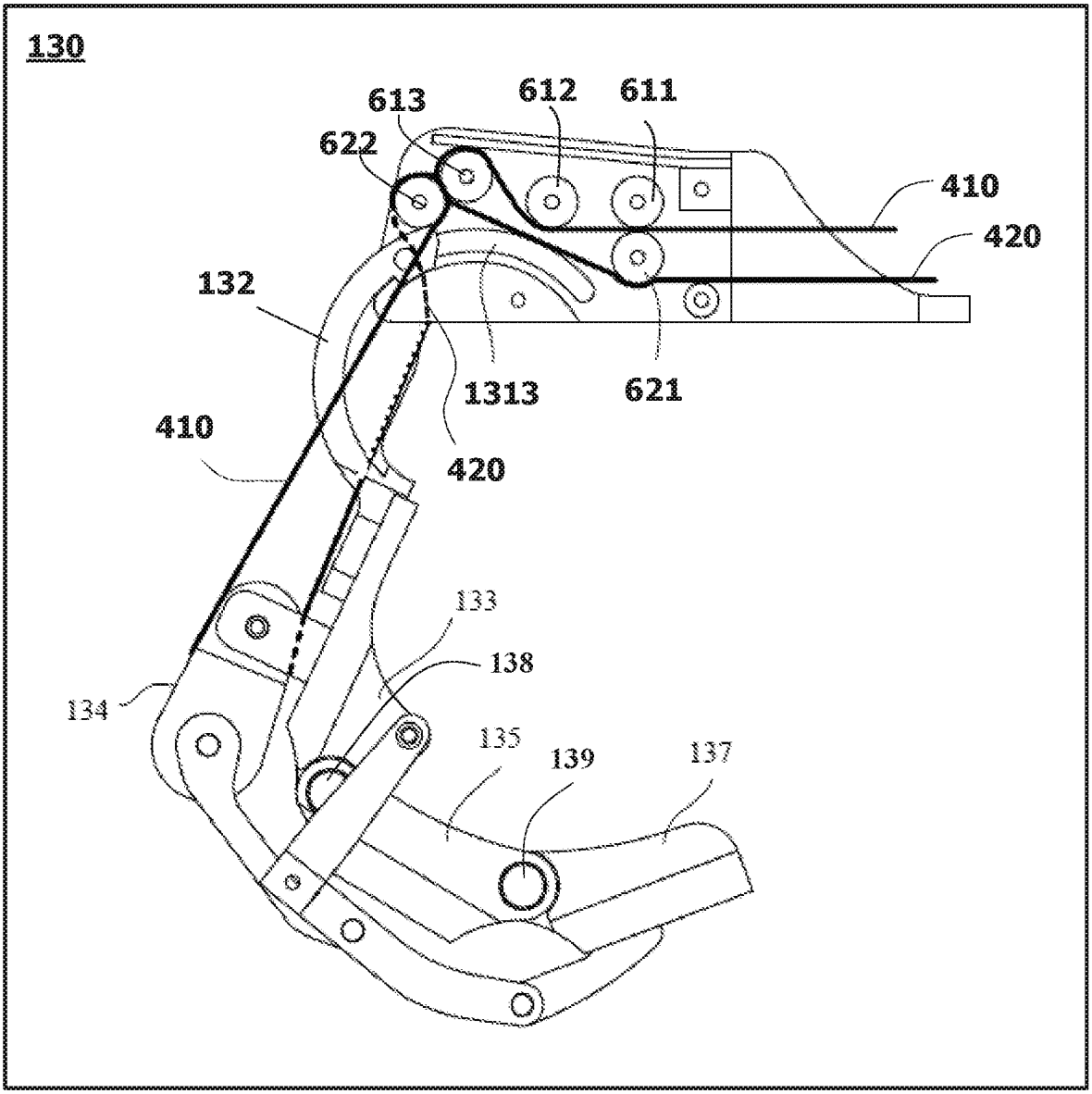
FIG. 6C is a schematic of illustrating a bending of a finger joint mechanism of a wearable hand rehabilitation system in accordance with the present invention.

FIG. 6B is a combination diagram of illustrating a finger joint mechanism of a wearable hand rehabilitation system in accordance with the present invention. As shown in FIG. 6B, in the case of the finger joint mechanism 130 combining the finger proximal phalanx 133 and the finger proximal phalanx 137 via the finger driving shaft 134 and becoming a straight line shape by pushing the joint to the one terminal, a virtual center point 140 that equals to an intersection of two normal lines with respect to two terminals of the finger slide linking bar 132 would form. This virtual center point 140, the finger proximal interphalangeal joint (PIP) 138 and the finger distal interphalangeal joint (DIP) 139 could be kept on a baseline. Moreover, the virtual center point 140 may be a reference point for the finger proximal phalanx 133 in bending. Furthermore, the finger proximal interphalangeal joint (PIP) 138 is used as a rotation center for the finger intermediate phalanx 135 in both bending and straighten motion, and the finger distal interphalangeal joint (DIP) 139 is used as a shaft for the finger proximal phalanx 137 during operation/in both bending and straighten motion. After the finger driving shaft 134 is driven by the transmission cable 400, the third link arm 1347 may be used as a guiding rod of force transferring for the driving part 1341 in rotating, so as to enable the finger slide linking bar 132 to move between the two terminals of the finger slide 1313. In another preferable embodiment of the present invention, the second link arm 1345 and the third link arm 1347 can be formed into one piece.

FIG. 6C is a schematic of illustrating action of a finger joint mechanism of a wearable hand rehabilitation system completed by the pulling of transmission cable in accordance with the present invention. As shown in FIG. 6C, the pulley set 600 including the plural cable pulleys is equipped onto the sidewall 1311 of the finger joint mechanism 130 and is used as a moving track of the transmission cable 400. In one embodiment of the present invention, the transmission cable 400 includes two independent cables: the straighten-end transmission cable 410 and the bending-end transmission cable 420. The pulley set 600 includes a first pulley set 611, 612, and 613 and a second pulley set 621, 622 for contacting the straighten-end transmission cable 410 and the bending-end transmission cable 420. The first pulley set 611, 612, and 613 contacts the straighten-end transmission cable 410, and the second pulley set 621, 622 contacts the bending-end transmission cable 420.

Moreover, one end of the straighten-end transmission cable 410 and one end of bending-end transmission cable 420 are coupled to the different positions of same motor 220; and the other end of the straighten-end transmission cable 410 and the other end of the bending-end transmission cable 420 are fixed onto the turntable (not shown) of the interior of the driving part 1341. Because the driving part 1341 in the present invention could be acquired by assembling, the interior of the driving part 1341 could be a hollow or a partial hollow structure, so that the turntable can be disposed in the interior of the driving part 1341. However, the main purpose of the turntable of the invention is that two end of the turntables (not shown) with different size to provide a displacement distance. When the driving part 1341 of the finger driving shaft 134 is driven in the rehabilitation assistive system 10, the straighten-end transmission cable 410 contacts the first pulley set 611, 612, 613 and the pulley 622, and the bending-end transmission cable 420 passes through the finger slide linking bar 132 first and then contacts the second pulley set 621, 622. The straighten-end transmission cable 410 and the bending-end transmission cable 420 may slide smoothly within the driving part 1341 by the guiding of the one or more turntables. It is understood that the finger metacarpophalangeal joint 131 and the thumb metacarpophalangeal joint 111 in FIG. 4A have same structures, so the ways that the straighten-end transmission cable 410 and the bending-end transmission cable 420 contact the first pulley set 611, 612, and 613, the second pulley set 621, 622 and the finger slide linking bar 132 are similar as those previously mentioned.

The respective ends of the bending-end transmission cable 420 and the straighten-end transmission cable 410 are coupled to the different positions of the same motor 220, and the respective other ends of the bending-end transmission cable 420 and the straighten-end transmission cable 410 are respectively fixed onto the finger driving shaft 134. When the motor 220 rotates towards/in counterclockwise direction, both the bending-end transmission cable 420 and the straighten-end transmission cable 410 are driven to move towards counterclockwise direction. The driving part 1341 of the finger driving shaft 134 is driven by the bending-end transmission cable 420 and the straighten-end transmission cable 410 to rotate towards/in counterclockwise direction. At this moment, the finger slide linking bar 132 of the finger metacarpophalangeal joint 131 is driven by the bending-end transmission cable 420 first to move along the finger slide 1313. The finger slide linking bar 132 will stop bending when it reaches to the terminal of the finger slide 1313. Next, the driving part 1341 will be continuously driven by the bending-end transmission cable 420 and the straighten-end transmission cable 410 to actuate the first link arm 1343 and the second link arm 1345. The finger proximal interphalangeal joint (PIP) and the finger distal interphalangeal joint (DIP) 139 are respectively driven by the pushed first link arm 1343 and the actuated second link arm 1345 to move and further drive the bending of the finger intermediate phalanx 135 and the finger proximal phalanx 137 in FIG. 6C. FIG. 6C is a schematic of illustrating a bending of a finger joint mechanism of a wearable hand rehabilitation system in accordance with the present invention. Furthermore, explosive drawing for the finger metacarpophalangeal joint 131 of the present invention is same as the thumb metacarpophalangeal joint 111 in FIG. 5, so it is not repeated herein.

Moreover, there are similar structure designs on the thumb metacarpophalangeal joint 111 of the thumb joint mechanism 110 and the finger metacarpophalangeal joint 131 of the finger joint mechanism 130, which include: the finger slide linking bar 132, the first pulley set 611, 612, 613 and the second pulley set 621, 622. Thus, the ways of cable routing of the bending-end transmission cable 420 and the straighten-end transmission cable 410 to drive the thumb driving shaft 114 of the thumb metacarpophalangeal joint 111 and the finger driving shaft 134 of the finger metacarpophalangeal joint 131 are similar to each other. However, difference is: after the thumb driving shaft 114 is driven by the bending-end transmission cable 420 and the straighten-end transmission cable 410, the thumb proximal phalanx 113 and the thumb distal phalanx 115 may be driven to bend or straighten with the thumb interphalangeal joint 117 as a rotation center; but after the finger driving shaft 134 is driven by the bending-end transmission cable 420 and the straighten-end transmission cable 410, the finger proximal phalanx 133 and the finger intermediate phalanx 135 may be driven to bend or straighten with the finger proximal interphalangeal joint (PIP) 138 as a rotation center, and both the finger intermediate phalanx 135 and the finger proximal phalanx 137 are also driven to bend or straighten with the finger distal interphalangeal joint (DIP) 139 as a rotation center.

As mentioned in FIG. 2A, the hand assistive unit 100 of the present invention includes the thumb joint mechanism 110, the four finger joint mechanisms 130 and the palm base 150. When corresponding to human hand, the structures and moving ways for the four finger joint mechanisms 130 are similar, so each the finger joint mechanisms 130 may be used as human index finger, middle finger, ring finger and pinky finger which are not repeatedly mentioned herein. It is noted that the thumb joint mechanism 110 and the four finger joint mechanisms 130 are positioned at different planes. However, the sizes of joints for the four finger joint mechanisms 130 used as human index finger, middle finger, ring finger and pinky finger may be different.

Please return to FIG. 2B again, the five transmission cables 400 are five pairs of the transmission cables corresponding to five fingers, respectively, which include: five pairs of the straighten-end transmission cables 410 and the bending-end transmission cables 420. Each pairs of the straighten-end transmission cables 410 and the bending-end transmission cables 420 with their one ends respectively are connected to the driving shafts 114, 134 of five fingers, passes the palm base 150, then connects to the plural sets of the elastic sensing rods 321 on the tension sensing unit 300, and is then pulled downward to connect to the corresponding motor 220. Thus, in the tension sensing unit 300, the five pairs of the elastic sensing rods 321 are arranged corresponding to the five pairs of the straighten-end transmission cables 410 and the bending-end transmission cables 420 for detecting the tensions of the straighten-end transmission cables 410 and the bending-end transmission cables 420. In a preferred embodiment of the present invention, the elastic pulley 312 is further arranged on the end of each the elastic sensing rod 321 for friction reduction when the straighten-end transmission cable 410 and the bending-end transmission cable 420 contact the elastic sensing rod 321.

Figure 7:
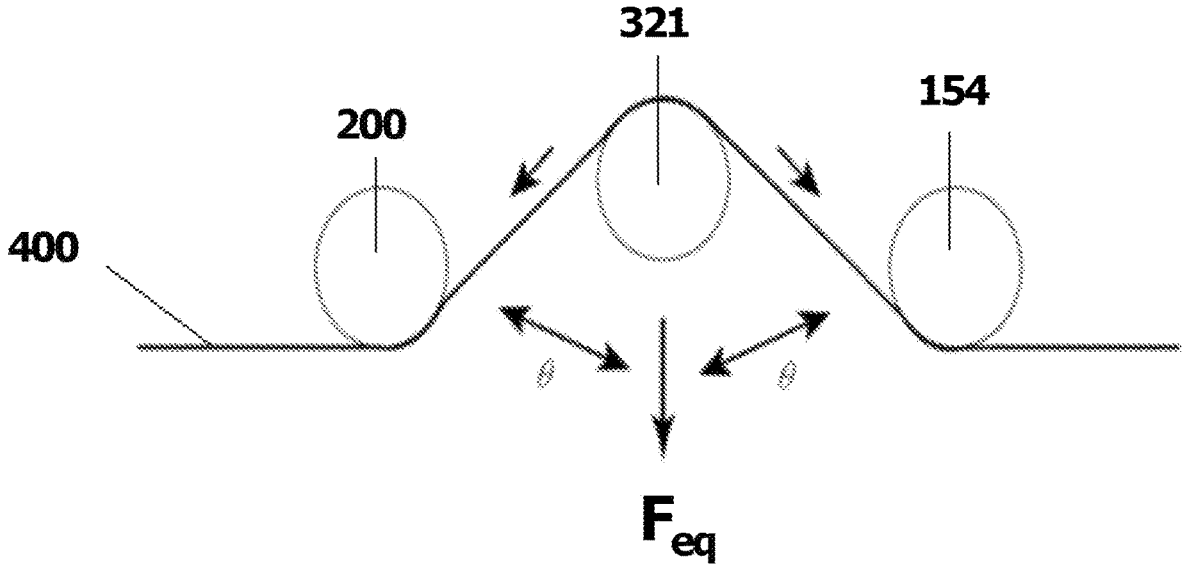
FIG. 7 is a schematic of illustrating a principle of tension sensor applied to a wearable hand rehabilitation system in accordance with the present invention.

Next, FIG. 7 is a schematic of illustrating a principle of tension sensor applied to a wearable hand rehabilitation system in accordance with the present invention. Please refer to FIG. 7 and FIG. 2B, in one embodiment of the present invention, the each elastic sensing rod 321 contacts the bending-end transmission cable 420 and the straighten-end transmission cable 410. When the motor 220 drives the bending-end transmission cable 420 and the straighten-end transmission cable 410 to move, both the bending-end transmission cable 420 and the straighten-end transmission cable 410 are pulled tightly and, with the elastic sensing rod 321 as a center, form the angles θ respective with the motor 220 and the driving shaft 114, 134. When equivalent force $F_{eq}$ acting on the elastic sensing rod 321 by the transmission cable 400 is acquired, the tension values on the bending-end transmission cable 420 and the straighten-end transmission cable 410 can be determined through the relationship of trigonometric function. The measured tension values can be transmitted to the control unit 500 for analysis and evaluation of user's finger situation.

Figure 8:
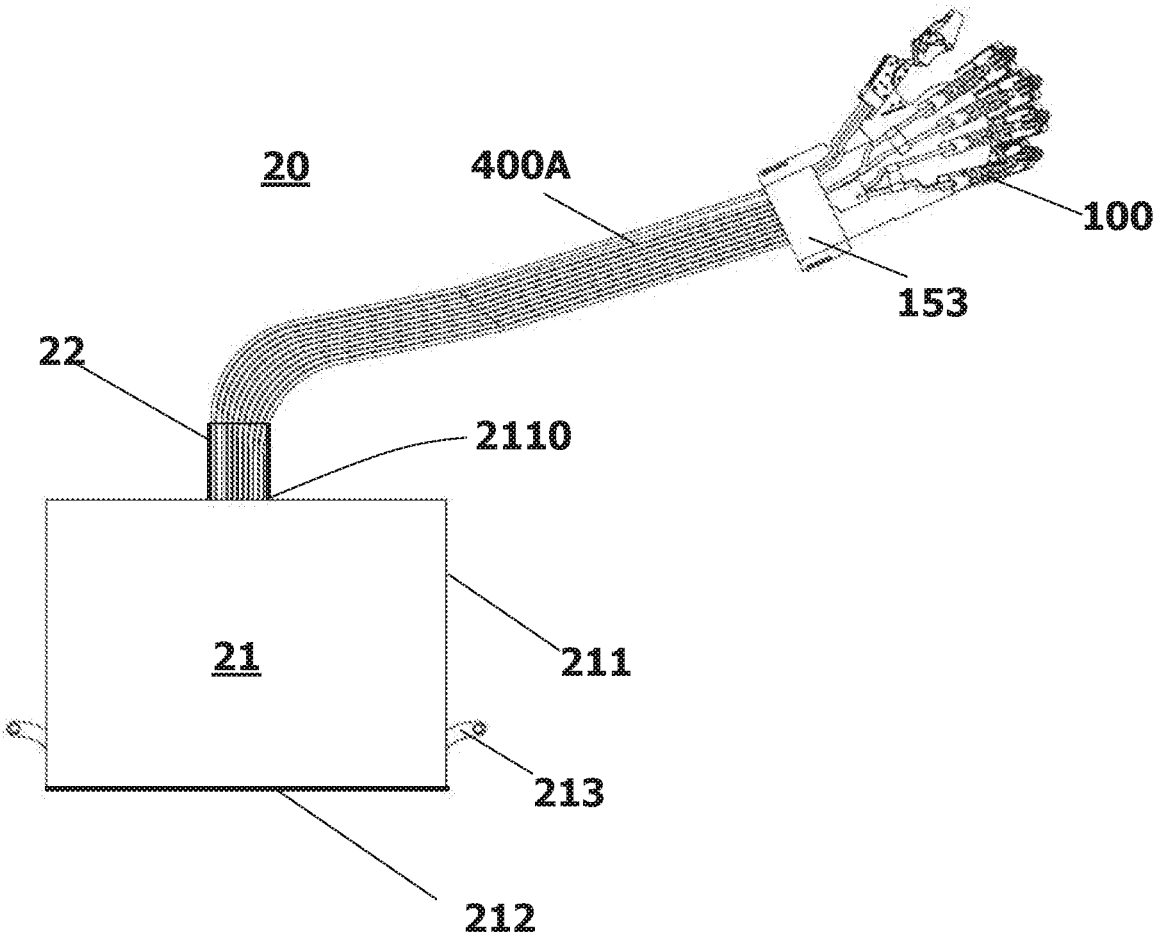
FIG. 8 is a schematic of illustrating another exemplary wearable hand rehabilitation system in accordance with the present invention.

Next, FIG. 8 is a schematical of illustrating another exemplary wearable hand rehabilitation system in accordance with the present invention. As shown in FIG. 8, a wearable hand rehabilitation system 20 includes a base 21, a hand assistive unit 100, plural pairs of sheaths 400A coupled to the base 21 and the hand assistive unit 100. The base 21 includes a cover 211, a base plate 212 and accommodation space between the cover 211 and the base plate 212. Next, a perforation 2110 is formed near a middle part of the cover 211, and a rigid tube 22 is positioned onto the perforation 2110 for each sheath 400A to pass through. Moreover, two handles 213 for handling the base 21 are positioned at opposite ends of the base plate 212. The hand assistive unit 100 of this embodiment is same as the ones mentioned in FIG. 3A to FIG. 6C, so as not to be repeated herein.

Figure 9:
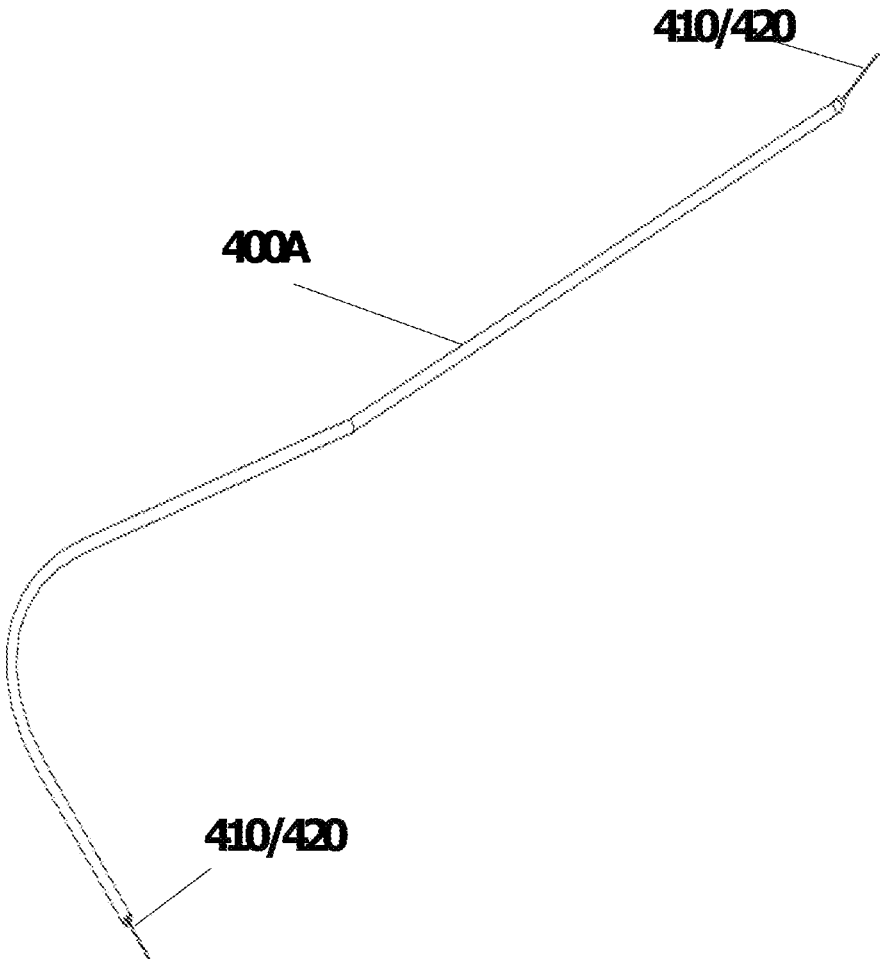
FIG. 9 is a schematic of illustrating a sheath in accordance with the present invention.

Next, FIG. 9 is a schematic of illustrating a sheath in accordance with the present invention. As shown in FIG. 9, each sheath 400A made of flexible material includes a hollow space to the each bending-end transmission cable 420 and the each straighten-end transmission cable 410 to pass through and slide therewithin. It is understood that the length of the each bending-end transmission cable 420 and the each straighten-end transmission cable 410 is longer than that of the exterior sheath 400A. Furthermore, the material of the sheath 400A may be metal, plastic, carbon fiber, glass or other suitable material to provide little-friction surface to the passing bending-end transmission cable 420 and the straighten-end transmission cable 410 within the hollow space of the sheath 400A. However, the material of the sheath 400A is not limited to aforementioned for the present invention.

Figure 10:
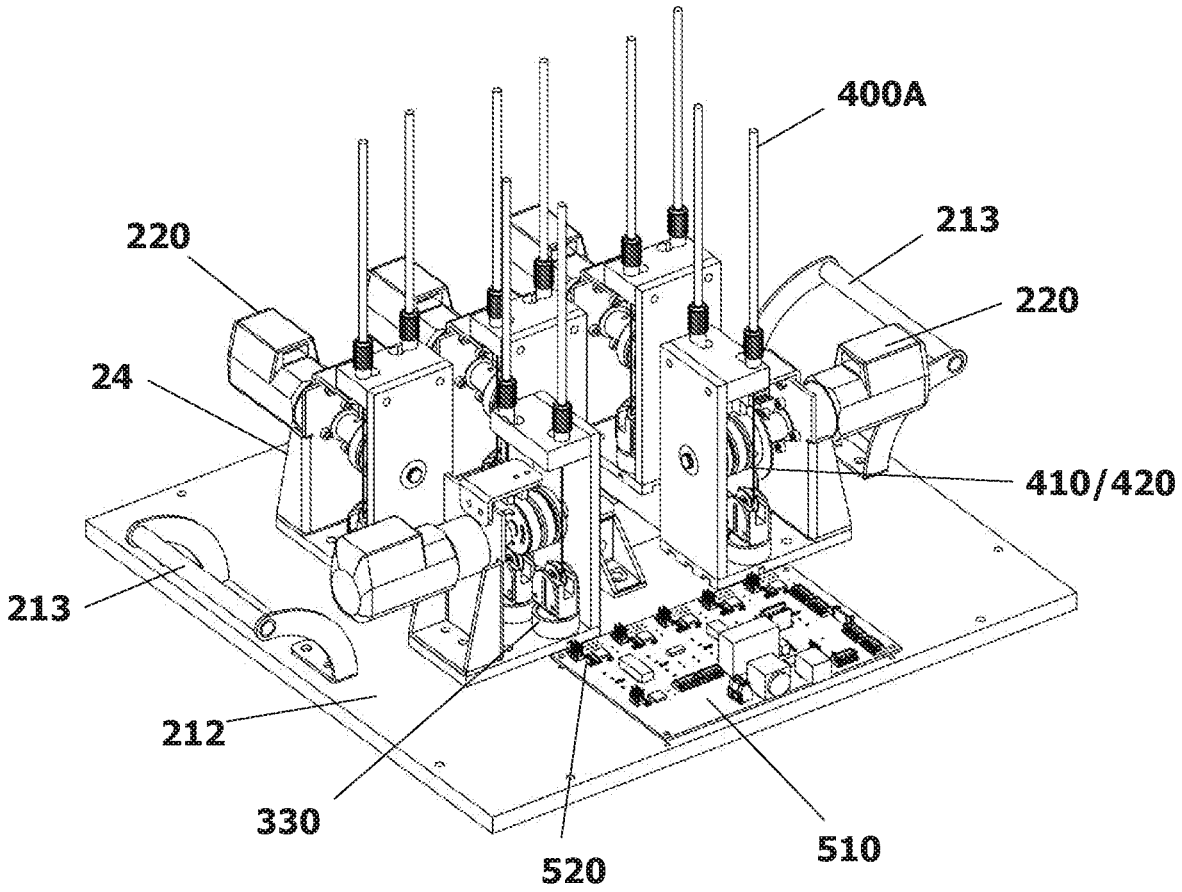
FIG. 10 is a schematic of illustrating interior of a base of a wearable hand rehabilitation system in accordance with the present invention.

Next, FIG. 10 is a schematic of illustrating interior of a base of a wearable hand rehabilitation system in accordance with the present invention. As shown in FIG. 10, five actuating units 24 are arranged onto the base plate 212 of the base 21, each of them may be coupled to respective one ends of one bending-end transmission cable 420 and one straighten-end transmission cable 410. The respective other ends of one bending-end transmission cable 420 and one straighten-end transmission cable 410 are coupled to either the thumb joint mechanism 110 or the finger joint mechanism 130 of the hand assistive unit 100. Besides, the each actuating unit 24 is also coupled to one motor 220 and is driven by rotating the motor 220 so that results in the rotation of the bending-end transmission cable 420 and the straighten-end transmission cable 410. Moreover, by the rotation of the bending-end transmission cable 420 and the straighten-end transmission cable 410, the thumb joint mechanism 110 or the finger joint mechanism 130 that couples to the other ends of the bending-end transmission cable 420 and the straighten-end transmission cable 410 may bend or straighten, and further make the user's finger bent or straighten simultaneously along the thumb joint mechanism 110 or the finger joint mechanism 130.

Please refer to FIG. 10, in one embodiment of the present invention, the three actuating units 24 are arranged in parallel on the base plate 212, and the another two actuating units 24 are adjacently arranged on the side wing of the three actuating units 24. However, it is not limited to the arrangement of the five actuating units 24 on the base plate 212 of the present invention. Furthermore, a servo control unit 510 formed of printed circuit board (PCB) could be positioned on vacant location adjacent to the five actuating units 24. The servo control unit 510 is provided with five servo circuits 520 respectively corresponding to each of the actuating units 24. Next, the servo control unit 510 is provided with an encoder and decoder (not shown in the figure) for receiving the commands from the control unit 500 and driving the rotation of the actuating unit 24. Moreover, the angular position of the motor 220 can also be encoded and transmitted back to the control unit 500. Next, there are handles 213 respectively arranged on two opposite ends of the base plate 212 for easily moving the base 21.

Figure 11A:
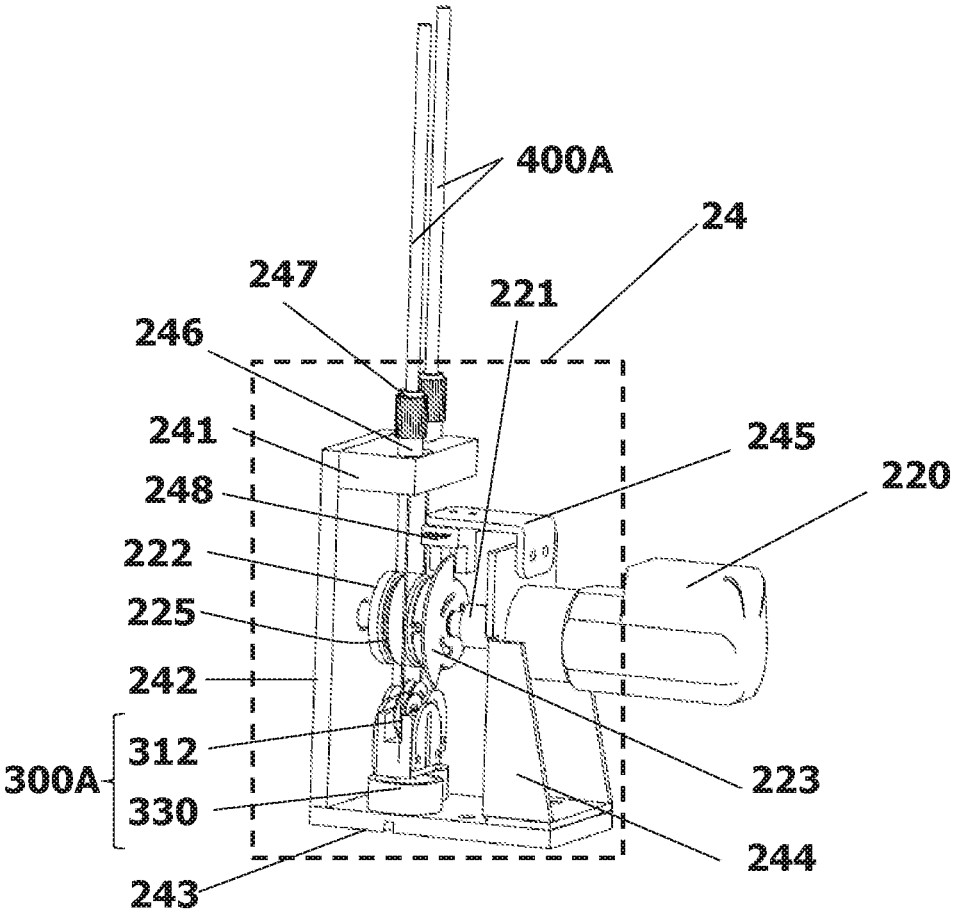
FIG. 11A is a stereoscopic diagram of illustrating an actuating unit in accordance with the present invention.
Figure 11B:
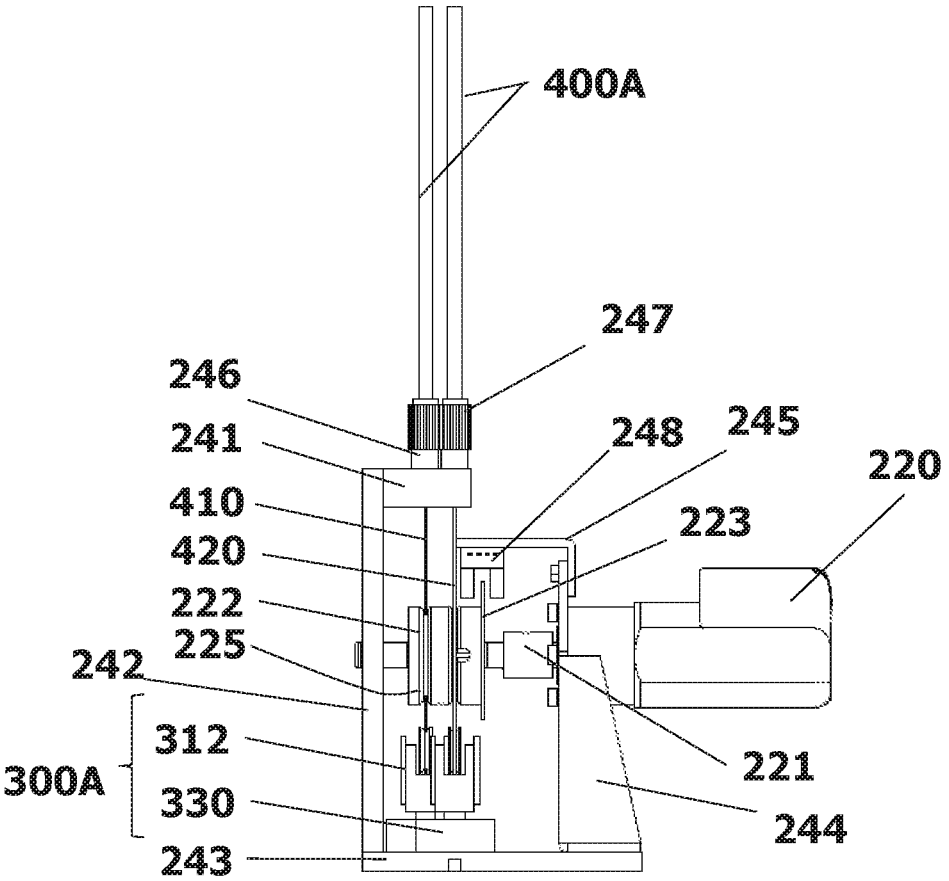
FIG. 11B is a side view of illustrating an actuating unit in accordance with the present invention.

FIG. 11A and FIG. 11B are stereoscopic diagram and side view of illustrating an actuating unit in accordance with the present invention. Please refer to FIG. 11A first, the actuating unit 24 includes a frame that has an upper plate 241 fixed to one end of a backplate 242 and the other end of the backplate 242 fixed to a bottom plate 243. Thus, the bottom plate 243 and the upper plate 241 are in parallel positioned at same sides of the backplate 242 with the height of the backplate 242 in between. Next, a support 244 is set on the other open end of the bottom plate 243 for supporting the motor 220. A through hole is on a plane of the support 244 to enable the shaft 221 of the motor 220 to pass through so that one end of the shaft 221 is coupled to a cylindrical spinner 222. Next, the other open end of the supporter 244 is fixed on a link plate 245. A photo interrupter 248 is equipped to the open end of the link plate 245 that is towards the backplate 242 and positioned right on the spinner 222.

Please refer to FIG. 11A again, there are two openings on the upper plate 241 and a rigid pipe 246 is embedded into each of the openings. The open end of the rigid pipe 246 that protrudes out of the upper plate 241 is provided with a knurled head 247. In the case of the each sheath 400A fixed onto the rigid pipe 246, by tuning/adjusting the knurled head 247 upwards and downwards, the relative distance between the two ends of the rigid pipe 246 that are coupled to the sheath 400A may increase or decrease to adjust/tune the relative tension of the bending-end transmission cable 420 and the straighten-end transmission cable 410 in the sheath 400A to reach a moderate tension margin of the transmission cable. Next, a pair of the tension sensing units 300A is arranged in the space onto the bottom plate 243, especially in the space between the backplate 242 and the support 244. It is understood that the spinner 222 is positioned in between the upper plate 241 and the tension sensing unit 300A with appropriate distance. As shown in FIG. 11B, there are two openings on the upper plate 241. The pair of the tension sensing units 300A are positioned in one-after-another arrangement instead of in-parallel alignment, which enables the bending-end transmission cable 420 and the straighten-end transmission cable 410 to contact the spinner 222 at different locations after respectively passing through the pair of the sheaths 400A on the upper plate 241. Such an arrangement may prevent the bending-end transmission cable 420 and the straighten-end transmission cable 410 from interfering or twisting.

Please refer to FIG. 11A again, the photo interrupter 248 is of inverse U-shaped structure and makes interruption control with arrangement of a photo diode and an oppositely positioned transistor. Next, a baffle 223 is positioned on one end of the motor 220 facing the spinner 222. A portion of a radius of the baffle 223 is bigger than that of the spinner 222 and the other portion of a radius is same as that of the spinner 222, and the radius of the baffle 223 same as that of the spinner 222 indicates that the baffle 223 and the spinner 222 have same circumference. The radius of another half of the baffle 223 is larger than that of the spinner 222. It is noted that the portion of larger radius may intervene in an inverse U-shaped structure of the photo interrupter 248 to shut down the transistor by blocking light signal of the photo interrupter 248. In the embodiments of the present invention, the angle of the motor 220 is restricted within 180 degrees that is a preset value and mentioned in following paragraphs. Accordingly, once the angle of the motor 220 is over 180 degrees, the transistor would be shut down because the portion of the bigger radius of the spinner 222 intervened into the photo interrupter 248, so that the motor would be forced to shut down and stop rotating. Besides, the signal forcing the motor to stop can be also transmitted into the control unit 500 via the encoder and decoder of the servo control unit 510 and enable the wearable hand rehabilitation system to stop acting for preventing the patient from being injured. It is noted that the present invention is not limited to how much size of the spinner 222 is selected to be the intervening portion, as well as what kinds of the photo interrupter 248.

Please refer to FIG. 11A, the bending-end transmission cable 420 and the straighten-end transmission cable 410 would contact the spinner 222 at different locations after respectively passing through the pair of the sheaths 400A on the upper plate 241. Such an arrangement may prevent the bending-end transmission cable 420 and the straighten-end transmission cable 410 from interfering or twisting. In the embodiments of the present invention, two parallel grooves 225 with space in between are formed in one-after-another arrangement in the spinner 222 for arranging the bending-end transmission cable 420 and the straighten-end transmission cable 410, respectively. The bending-end transmission cable 420 and the straighten-end transmission cable 410 are fixed onto the spinner 222 by respectively routing the bending-end transmission cable 420 and the straighten-end transmission cable 410 on the respective grooves 225 with at least one round. Moreover, in order to make both the bending-end transmission cable 420 and the straighten-end transmission cable 410 be straightly vertical to the bottom plate 243 when they contact the spinner 222 and the elastic pulley 312 on the tension sensing unit 300A, the pair of the tension sensing units 300A is in one-after-another arrangement instead of in-parallel alignment and is aligned with the position of the two grooves 225 of the spinner 222. The arrangement that the bending-end transmission cable 420 and the straighten-end transmission cable 410 are perpendicular to the bottom plate 243 can prevent the bending-end transmission cable 420 and the straighten-end transmission cable 410 from forming any offset angle. It is understood if the offset angle is formed during the motor 220 rotates, the deviation of bending-end transmission cable 420 and of the straighten-end transmission cable 410 generate additional equivalent force at the elastic pulley 312 to result in the erroneous tension value feedbacked by the tension sensor 330, so that the control unit 500 would possibly erroneously determine the angle of the motor 220 during rehabilitation to make the patient to be injured.

Figure 12:
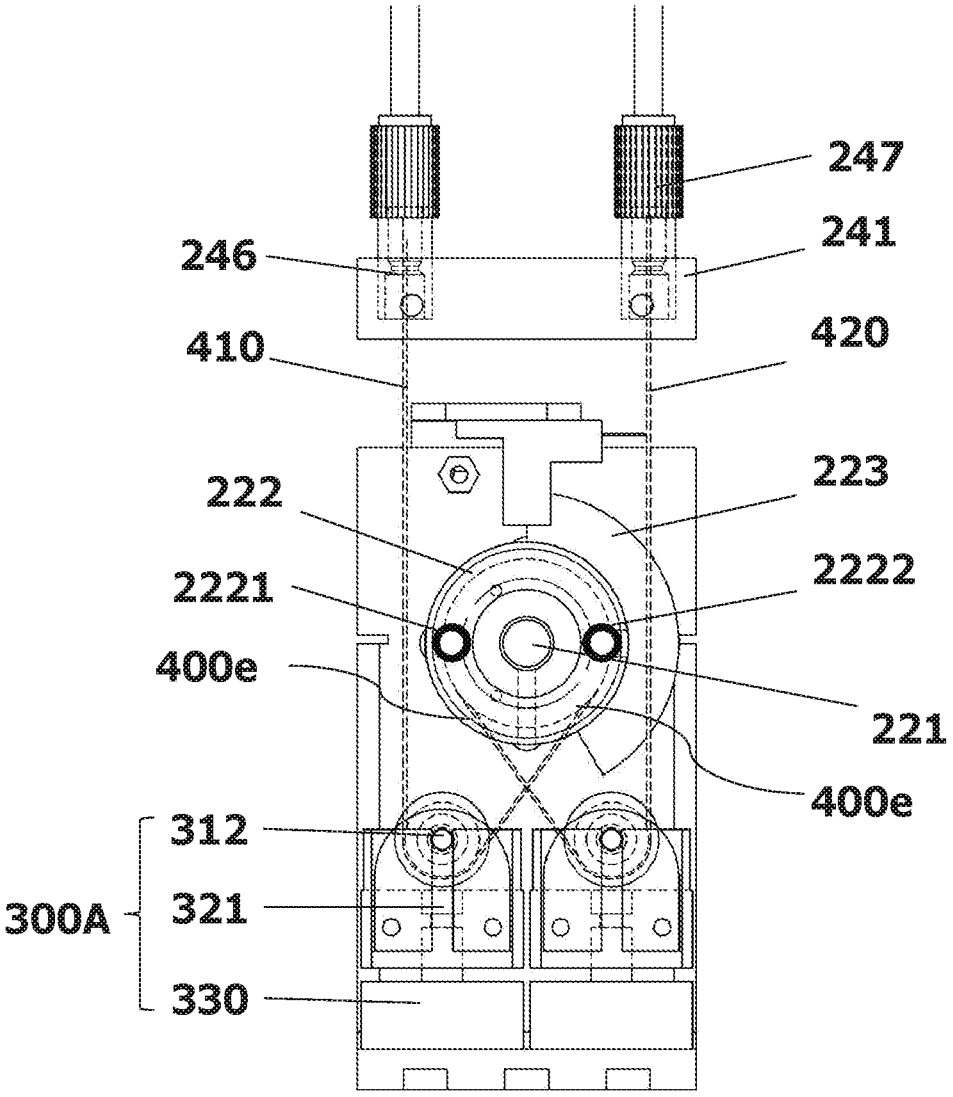
FIG. 12 is a schematic of illustrating connection of a transmission cable with a spinner and a tension sensor in accordance with the present invention.

FIG. 12 is a schematic of illustrating connection of a transmission cable with a spinner and a tension sensor in accordance with the present invention. As shown in FIG. 12, the tension sensing unit 300A is provided with the elastic pulley 312, the elastic sensing rod 321, and a tension sensor 330 fixed onto the bottom plate 243. The tension sensor 330 is coupled to the elastic pulley 312 with the elastic sensing rod 321, so that the tension sensor 330 keeps a distance away from the elastic pulley 312. Moreover, the spinner 222 is provided with a pair of fixing points 2221, 2222 at one side end thereof opposite to the baffle 223. After respectively passing through the pair of the sheaths 400A of the upper plate 241, the bending-end transmission cable 420 and the straighten-end transmission cable 410 may pass different elastic pulleys 312 and then be straighteningly pulled toward the spinner 222. Thus, the bending-end transmission cable 420 and the straighten-end transmission cable 410 may contact the different elastic pulleys 312. Next, the terminals 400*e* of bending-end transmission cable 420 and the straighten-end transmission cable 410 are fixed onto the fixing points 2221, 2222 of the spinner 222 after the bending-end transmission cable 420 and the straighten-end transmission cable 410 are respectively routed on the different grooves 225 on the spinner 222 with at least one round (not shown). Consequently, when the motor 220 drives the spinner 222 to rotate, it can directly tighten or loosen both the bending-end transmission cable 420 and the straighten-end transmission cable 410, and further drag either the thumb joint mechanism 110 or the finger joint mechanism 130 to bend.

When the patient who needs to do thumb rehabilitation wears his/her thumb into the thumb joint mechanism 110 of the wearable hand rehabilitation system 20 and has been evaluated by a rehabilitation operator/medical personnel, the motor 220 can be driven by receiving the commands from the control unit 500, to further rotate the spinner 222 simultaneously, and pull both the bending-end transmission cable 420 and the straighten-end transmission cable 410 to move along therewith. The tension forces respective on the bending-end transmission cable 410 and the straighten-end transmission cable 420 can be measured via the elastic sensing rod 321 because both the bending-end transmission cable 410 and the straighten-end transmission cable 420 contact the elastic pulley 312 of the tension sensing unit 300 during the operation. Besides, during a rehabilitation process, a predetermined value may be set by the control unit 500. When the tension value of thumb is over the predetermined value, the wearable hand rehabilitation system would stop acting under the commands of the control unit 500 to prevent the patient from being injured. Moreover, the wearable hand rehabilitation system 20 of the present invention may also utilize the baffle 223 on the spinner 222 as a protection mechanism to force the motor 220 to stop turning or rotating.

Furthermore, the sheath 400A made of flexible material may move along with the hand assistive unit 100 when putting onto the patient's arm in movement. Thus, after the patient wears the wearable hand rehabilitation system 20 of the present invention, the patient may do rehabilitation under the control of the control unit 500 respectively on the thumb joint mechanism 110 or the individual finger joint mechanism 130. Moreover, the wearable hand rehabilitation system 20 of the present invention may further provide the complete functions for hand rehabilitation. For example, when a user put on the wearable hand rehabilitation system 20 of the present invention, the user could move or rotate his/her arm to make his/her five fingers to grab something under the control of the control unit 500. The use of the wearable hand rehabilitation system could evaluate the hand rehabilitation condition of the user.

Figure 13A:
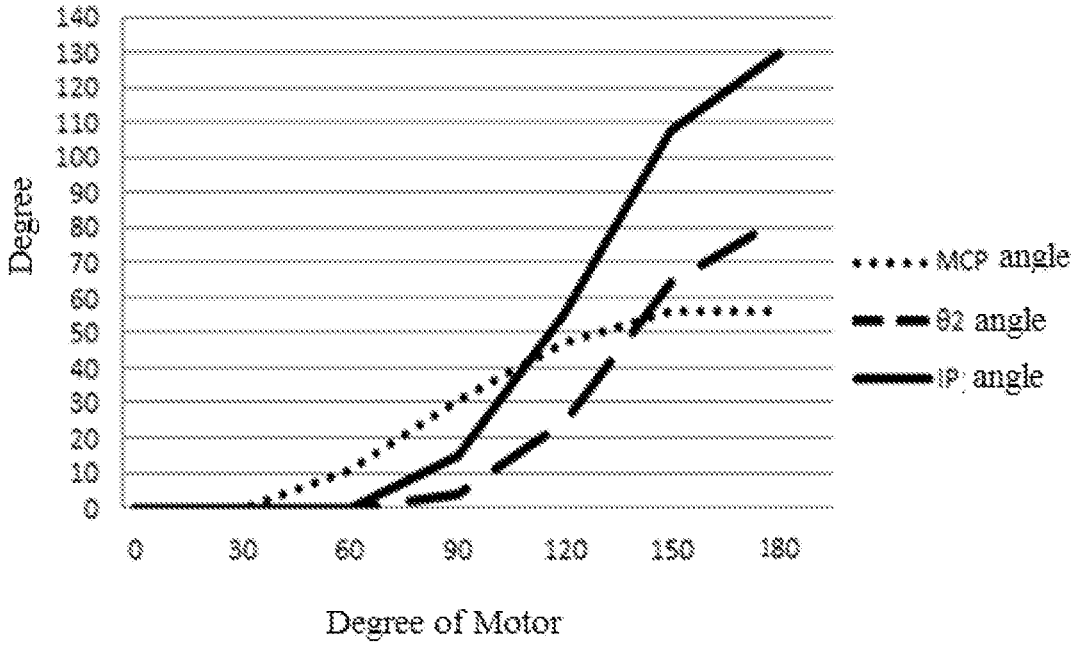
FIG. 13A is a schematic of illustrating a comparison of a rotation angle of joint mechanism motor with a bending degree of a thumb joint in accordance with the present invention.

FIG. 13A is a schematic of illustrating a comparison of a rotation angle of joint mechanism motor with a bending degree of a thumb joint in accordance with the present invention. As shown FIG. 13A, the horizontal axis is the motor position of the motor and the vertical axis is the bending angle of the thumb joint mechanism. The dot line represents the rotation angle of the Metacarpophalangeal (MCP) corresponding to the thumb metacarpophalangeal joint 111; the long dash line "$\theta_2$" represents the rotation angle of the thumb interphalangeal joint 117; and the solid line represents the rotation angle of the IP (Interphalanxal) corresponding to the thumb driving shaft 114. First, for the rotation angle of the thumb metacarpophalangeal joint 111, when the motor 220 turns to about 30 degrees, the bending-end transmission cable 420 and the straighten-end transmission cable 410 are driven by it to move along with it. At this moment, the thumb slide linking bar 112 in the thumb metacarpophalangeal joint 111 can be driven by the bending-end transmission cable 420 to move, so that the thumb slide linking bar 112 begins to slide and bend first in response to the pulling of the bending-end transmission cable 420. Next, when the motor 220 continuously turns to about 140 degrees, the thumb slide latch 1124 has moved to the terminal of the thumb slide 1113. It is obvious that the thumb metacarpophalangeal joint 111 stops bending. At this moment, referred to the vertical axis, the thumb metacarpophalangeal joint 111 is bent close to 60 degrees. That is to say, in the embodiment of the present invention, the max bending degree of the thumb metacarpophalangeal joint 111 is 60 degrees. Next, it is noted that the thumb metacarpophalangeal joint 111 is connected to the palm base 150 and the thumb proximal phalanx 113 so that the thumb proximal phalanx 113 can be driven by the thumb metacarpophalangeal joint 111 and bend along with the bending of the thumb metacarpophalangeal joint 111.

Next, for the rotation angle of the thumb driving shaft 114 in FIG. 13A, when the motor 220 turns to 60 degrees, the motor 220 continuously turns and pulls the bending-end transmission cable 420 and the straighten-end transmission cable 410, so that the thumb driving shaft 114 is driven by the bending-end transmission cable 420 and the straighten-end transmission cable 410 to move, and the angle movement is shown as the solid line "$\theta_2$". Thus, the thumb distal phalanx 115 can be driven by the rotation angle of the thumb driving shaft 114 to bend with respect to the thumb interphalangeal joint 117. For example, when the motor 220 pulls the bending-end transmission cable 420 and the straighten-end transmission cable 410 and turns to about 60 degrees, the thumb driving shaft 114 begins to rotate in response to the pulling force so as to increase the angle "$\theta_2$" of the thumb driving shaft 114. It is obvious that, in the embodiment of the present invention, the thumb driving shaft 114 is first bent by the pulling of the bending-end transmission cable 420 and the straighten-end transmission cable 410, so the bending angle thereof is quickly formed. Next, during the bending process of the thumb driving shaft 114, the thumb distal phalanx 115 may be pulled to make the thumb interphalangeal joint 117 bend. When the angle "$\theta_2$" of the thumb driving shaft 114 reaches to 130 degrees, the bending of the thumb interphalangeal joint 117 reaches to the max bending degree. Besides, when the motor 220 turns to 60 degrees, the thumb metacarpophalangeal joint 111 has bent to 20 degrees. At this moment, the thumb driving shaft 114 begins to be pulled by the bending-end transmission cable 420 and the straighten-end transmission cable 410 and bend, and then the thumb distal phalanx 115 is driven to bend. It is noted that, in the embodiment of the present invention, during the motor 220 turns about from 60 to 140 degrees, the thumb metacarpophalangeal joint 111 in the thumb joint 110, the thumb driving shaft 114 and the thumb distal phalanx 115 would simultaneously bend.

When the patient who needs to do thumb rehabilitation wears his/her thumb into the thumb joint mechanism of the wearable hand rehabilitation system and has been evaluated by a rehabilitation operator/medical personnel, the motor 220 can be driven by receiving commands of the control unit 500 to rotate and pull both the bending-end transmission cable 420 and the straighten-end transmission cable 410 to move along therewith. The tension forces respective on the bending-end transmission cable 410 and the straighten-end transmission cable 420 can be measured because both the bending-end transmission cable 410 and the straighten-end transmission cable 420 contact the elastic sensing rod 321 of the tension sensing unit 300 during the operation. Besides, during a rehabilitation process, a predetermined value may be set by the control unit 500. When the tension value of thumb is over the predetermined value, the wearable hand rehabilitation system would stop acting based on the commands of the control unit 500 to prevent the patient from being injured. The predetermined value can be changed according to different patients' situation by a doctor.

Figure 13B:
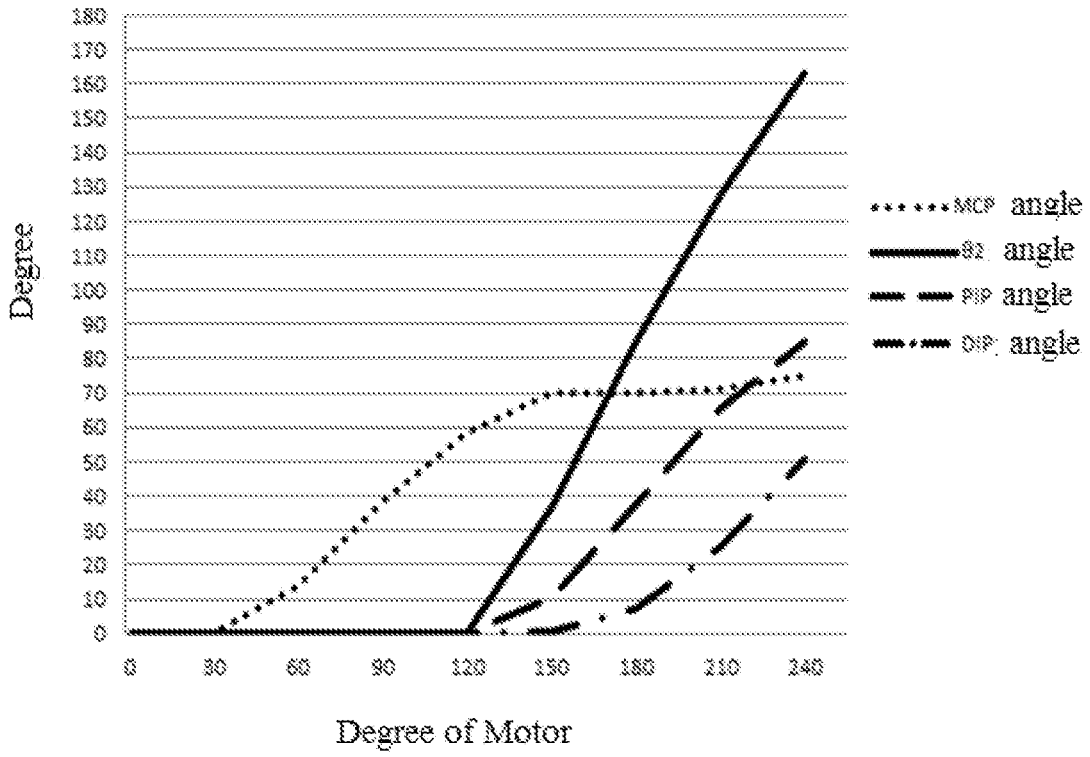
FIG. 13B is a schematic of illustrating a comparison of a rotation angle of joint mechanism motor with a bending degree of a finger joint in accordance with the present invention.

FIG. 13B is a schematic of illustrating a comparison of a rotation angle of joint mechanism motor with a bending degree of a finger joint in accordance with the present invention. As shown in FIG. 13B, the horizontal axis is the motor position of the motor and the vertical axis is the bending angle of the finger joint mechanism. The dot line represents the rotation angle of the Metacarpophalangeal (MCP) corresponding to the finger metacarpophalangeal joint 131; the long dash line represents the rotation angle of the proximal interphalanxal (PIP) corresponding to the finger proximal interphalangeal joint (PIP) 138; the short dash line represents the rotation angle of the Distal interphalanxal (DIP) corresponding to the finger distal interphalangeal joint (DIP) 139; and solid line "$\theta_2$" is the rotation of the finger driving shaft 134. First, when the motor 220 turns to about 30 degrees, the bending-end transmission cable 420 and the straighten-end transmission cable 410 are driven by it to move along with it. At this moment, the finger slide linking bar 132 in the finger metacarpophalangeal joint 131 can be driven by the bending-end transmission cable 420 to move, so that the finger slide linking bar 132 begins to slide first in response to the pulling of the bending-end transmission cable 420, and then the finger metacarpophalangeal joint 131 is driven by the finger slide linking bar 132 to bend. When the motor 220 continuously turns to about 150 degrees, the finger slide latch 1324 has moved to the terminal of the finger slide 1313 and then the finger metacarpophalangeal joint 131 stops bending. At this moment, referred to the vertical axis, the finger metacarpophalangeal joint 131 is bent close to 70 degrees. That is to say, in the embodiment of the present invention, the max bending degree of the finger metacarpophalangeal joint 131 is 70 degrees. Next, it is noted that the finger metacarpophalangeal joint 131 and the finger proximal phalanx 133 are connected into one piece so that the finger proximal phalanx 133 can be driven by the finger metacarpophalangeal joint 131 and bend along with the bending of the finger metacarpophalangeal joint 131.

Next, shown in FIG. 13B, when the motor 220 turns to 120 degrees, the motor 220 continuously turns and pulls the bending-end transmission cable 420 and the straighten-end transmission cable 410, so that the finger driving shaft 134 is driven by the bending-end transmission cable 420 and the straighten-end transmission cable 410 to move, and the angle movement is shown as the solid line "$\theta_2$". Moreover, both the finger proximal interphalangeal joint (PIP) 138 and the finger distal interphalangeal joint (DIP) 139 are driven to rotate, too. When the motor 220 turns to over 120 degrees, the finger metacarpophalangeal joint 131 has slided to the terminal of the finger slide 1313 and stopped bending. At this moment, the pulling of the transmission cable 400 can be guided to the finger driving shaft 134, and by the rotation of the finger driving shaft 134, the finger proximal interphalangeal joint (PIP) 138 between finger proximal phalanx 133 and the finger intermediate phalanx 135 can be pushed to bend. For example, when the motor 220 pulls the bending-end transmission cable 420 and the straighten-end transmission cable 410 and turns to about 120 degrees, the finger driving shaft 134 begins to rotate in response to the pulling force so as to increase the angle "$\theta_2$" of the finger driving shaft 134. It is obvious that, in the embodiment of the present invention, the finger driving shaft 134 is first bent by the pulling of the bending-end transmission cable 420 and the straighten-end transmission cable 410, so the bending angle thereof is observed easily. Next, when the motor 220 turns to 120 degrees, by the rotation angle of the finger driving shaft 134, the finger proximal interphalangeal joint (PIP) 138 between the finger proximal phalanx 133 and the finger intermediate phalanx 135 is driven to bend, as well as the finger distal interphalangeal joint (DIP) 139 between the finger proximal phalanx 137 and the finger intermediate phalanx 135. However, the bending of the finger proximal interphalangeal joint (PIP) 138 is observed more obviously than that of the finger distal interphalangeal joint (DIP) 139. When the motor 220 turns to 240 degrees, the finger metacarpophalangeal joint 131 is kept at the max bending angle of 70 degrees, the bending angle of the finger proximal interphalangeal joint (PIP) 138 is close to 90 degrees, the bending angle of the finger distal interphalangeal joint (DIP) 139 is close to 50 degrees, and the rotation of the finger driving shaft 134 may reach close to 160 degrees.

It is noted that the driving for the bending of the finger joint mechanism 130 is different from that for the bending of the thumb joint mechanism 110. In an example of the bending of the finger joint mechanism 130, before the motor 220 turns to reach 120 degrees, the finger metacarpophalangeal joint 131 of the finger joint 130 is forced to bend the finger driving shaft 134. At this moment, other parts including the proximal interphalangeal joint (PIP) 138 and the finger distal interphalangeal joint (DIP) 139 do not rotate yet. During the motor 220 turns from 120 degrees to 240 degrees, the finger driving shaft 134 may drive both the finger proximal interphalangeal joint (PIP) 138 and the distal interphalangeal joint (DIP) 139 to bend together, but the bending margin of the finger proximal interphalangeal joint (PIP) 138 is more obvious than that of the distal interphalangeal joint (DIP) 139. At this moment, the bending angle of the finger metacarpophalangeal joint 131 is kept about 70 degree.

Similarly, When the patient who needs to do finger rehabilitation wears his/her fingers into the finger joint mechanism 130 of the wearable hand rehabilitation system 10 and has been evaluated by a rehabilitation operator/medical personnel, the motor 220 can be driven by receiving commands from the control unit 500 to rotate and pull both the bending-end transmission cable 420 and the straighten-end transmission cable 410 to move along therewith. The tension forces respective on the bending-end transmission cable 410 and the straighten-end transmission cable 420 can be measured because both the bending-end transmission cable 410 and the straighten-end transmission cable 420 contact the elastic sensing rod 321 of the tension sensing unit 300 during the operation. Besides, during a rehabilitation process, a predetermined value may be set by the control unit 500. When the tension value of finger is over the predetermined value, the wearable hand rehabilitation system would stop acting based on the commands of the control unit 500 to prevent the patient from being injured. The predetermined value can be changed according to different patients' situation by a doctor.

Figure 14A:
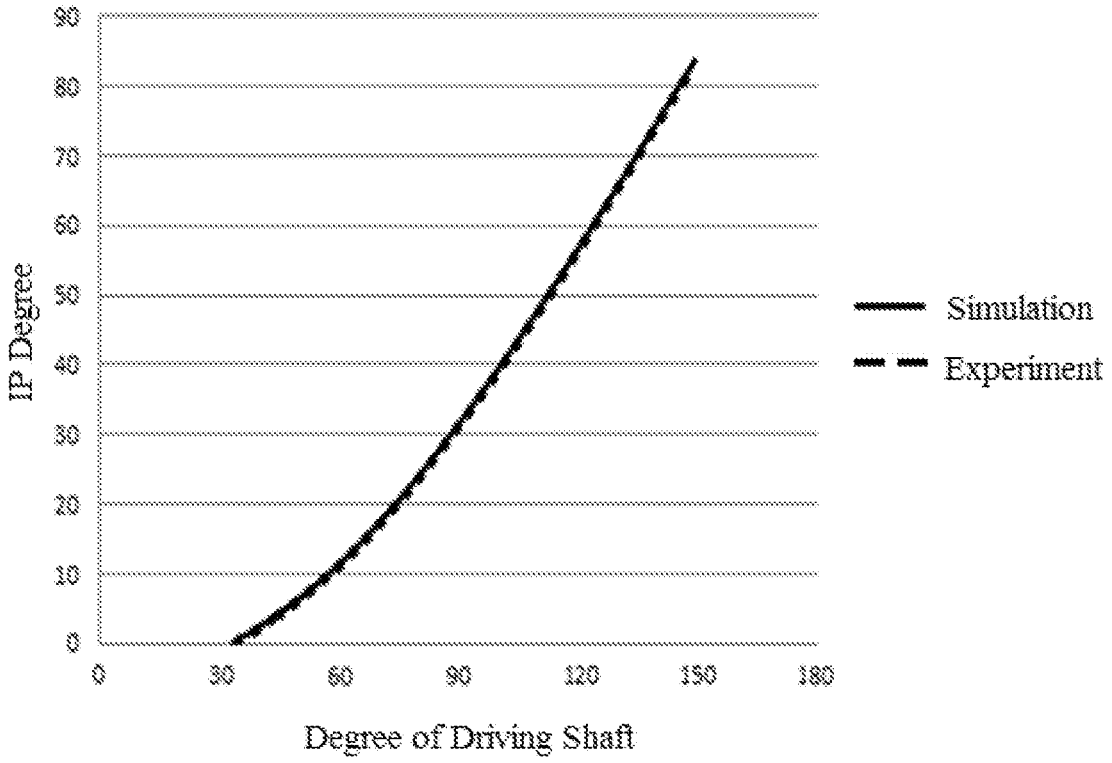
FIG. 14A is a schematic of illustrating a comparison of a rotation angle of a motor of a wearable hand rehabilitation system with a bending degree of a thumb interphalangeal joint in accordance with the present invention.

FIG. 14A is a schematic of illustrating a comparison of a simulation (solid line) and practical experiment (dash line) for the rotation angle of the thumb driving shaft 114 of the wearable hand rehabilitation system with a bending degree of a thumb interphalangeal joint in accordance with the present invention. As shown in FIG. 14A, the relative angle of the thumb interphalangeal joint (IP) corresponding to the thumb distal phalanx 115 and the thumb proximal phalanx 113 is equal to the rotation angle of the thumb interphalangeal joint 117. The solid line is a simulation result representing the bending process of the thumb joint of the wearable hand rehabilitation system of the present invention, and the dash line represents the practical bending result of the thumb joint of the wearable hand rehabilitation system of the present invention after being driven by the motor. Please refer to FIG. 14A, when the angle "$\theta_2$" of the thumb driving shaft 114 reaches to about 40 degrees, the thumb interphalangeal joint 117 begins to bend. In FIG. 14A, it is noted that the analog curve solid line and the curve dash line representing the bending of the thumb joint practically driven by the turning angle of the motor are consistent. Consequently, the design of the thumb joint mechanism 110 of the present invention is close to theoretic result. Thus, the wearable hand rehabilitation system of the present invention could not be equipped with various sensor components within the thumb joint mechanism 110 and be simplized with pulling of cables, which is beneficial in reducing weight and manufacturing cost of assistive device.

Figure 14B:
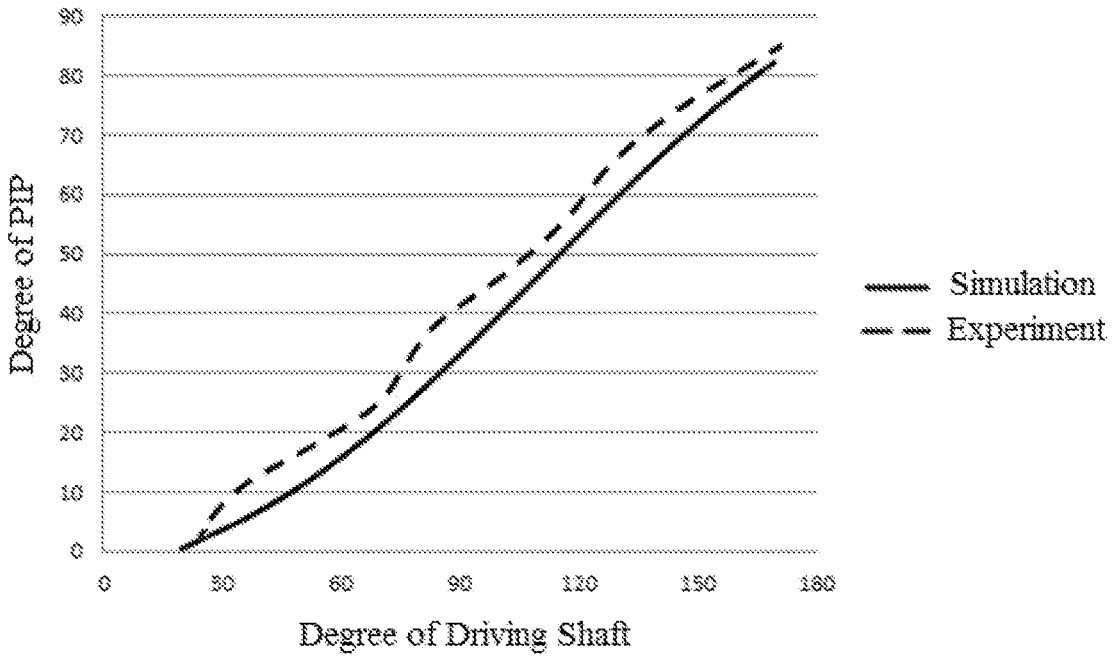
FIG. 14B is a schematic of illustrating a comparison of a rotation angle of a motor of a wearable hand rehabilitation system with a bending degree of a proximal interphalangeal joint (PIP) in accordance with the present invention.

FIG. 14B is a schematic of illustrating a comparison of simulation (solid line) and practical experiment (dash line) for the rotation angle of the finger driving shaft 134 of the wearable hand rehabilitation system with a bending degree of a finger proximal interphalangeal joint (PIP) in accordance with the present invention. As shown in FIG. 14B, the proximal interphalangeal joint (PIP) is corresponding to the rotation angle of the finger proximal interphalangeal joint (PIP) 138. When the angle "$\theta_2$" of the finger driving shaft 134 reaches to about 20 degrees, the finger proximal interphalangeal joint (PIP) 138 begins to bend. When the angle "$\theta_2$" of the finger driving shaft 134 turns from 20 degrees to reach to about 150 degrees, the bending of the finger proximal interphalangeal joint (PIP) 138 is about linear. In FIG. 14B, it is noted that the analog curve solid line and the curve dash line representing the bending of the finger proximal interphalangeal joint (PIP) 138 practically driven by the angle of the motor are consistent.

Figure 14C:
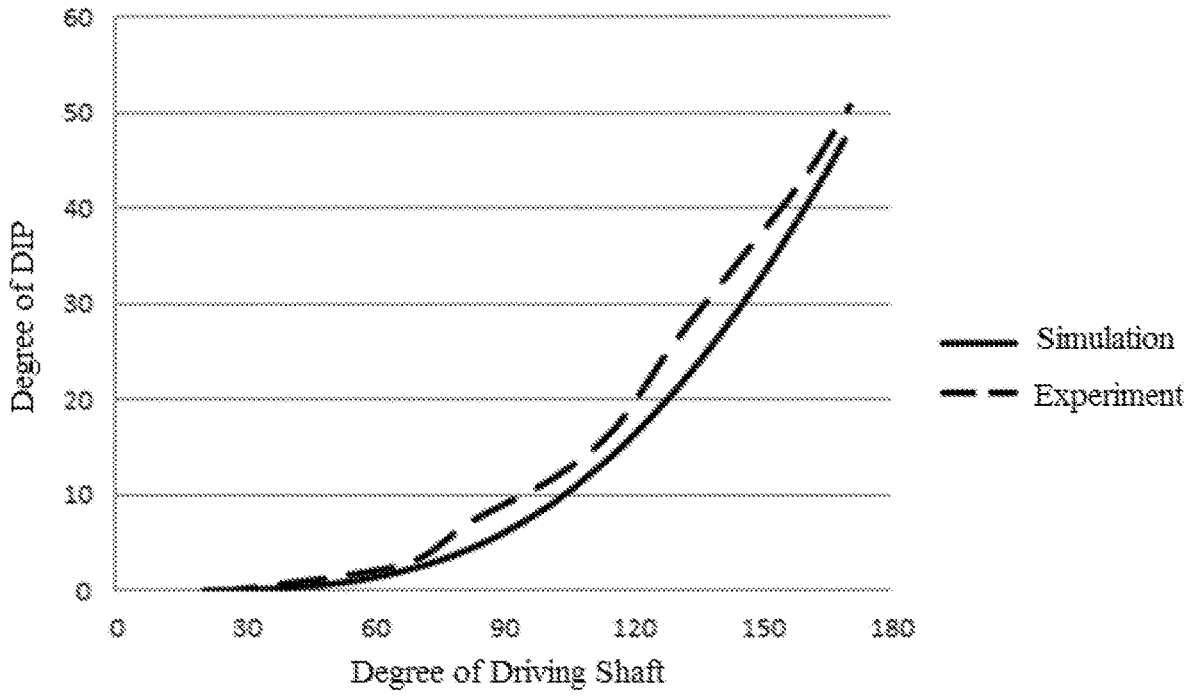
FIG. 14C is a schematic of illustrating a comparison of a rotation angle of a motor of a wearable hand rehabilitation system with a bending degree of a distal interphalangeal joint (DIP) in accordance with the present invention.

FIG. 14C is a schematic of illustrating a comparison of simulation (solid line) and practical experiment (dash line) for the rotation angle of the finger driving shaft 134 of the wearable hand rehabilitation system with a bending degree of a distal interphalangeal joint (DIP) in accordance with the present invention. As shown in FIG. 14C, the distal interphalangeal joint (DIP) is corresponding to the rotation angle of the finger distal interphalangeal joint (DIP) 139 When the angle "$\theta_2$" of the finger driving shaft 134 reaches to about 15 degrees, the finger distal interphalangeal joint (DIP) 139 begins to bend. In FIG. 14C, it is noted that the analog curve solid line and the curve dash line representing the bending of the distal interphalangeal joint (DIP) practically driven by the angle of the motor are consistent.

From the comparison results of FIG. 14B and FIG. 14C, the rotation angle of the motor and the bending track of the finger proximal interphalangeal joint (PIP), the rotation angle of the motor and the analog curve solid line representing the bending track of the finger distal interphalangeal joint (DIP) and the curve dash line representing the bending of the finger distal interphalangeal joint (DIP) practically driven by the angle of the motor are consistent. Accordingly, the design of the finger joint mechanism 130 of the present invention is close to theoretic result. Thus, the wearable hand rehabilitation system of the present invention could not be equipped with various sensor components within the finger joint mechanism 130 and be simplized with pulling of cables. From the results of FIG. 14A, FIG. 14B and FIG. 14C, the wearable hand rehabilitation system of the present invention is beneficial in reducing weight and manufacturing cost of assistive device.

While the invention has been described in terms of what is presently considered to be the most practical and preferred embodiments, it is to be understood that the invention needs not be limited to the disclosed embodiments. On the contrary, it is intended to cover various modifications and similar arrangements included within the spirit and scope of the appended claims which are to be accorded with the broadest interpretation so as to encompass all such modifications and similar structures.

What is claimed is:

1. A wearable hand rehabilitation system, comprising:

a base provided with a cover and a base plate, an accommodation space formed between the cover and the base plate, and a perforation formed near a middle part of the cover;

a hand assistive unit provided with a thumb joint mechanism and a plurality of finger joint mechanisms, wherein the thumb joint mechanism and each of the finger joint mechanisms are equipped with a driving shaft, respectively;

a plurality of actuating units arranged on the base plate of the base;

a plurality of pairs of sheaths, an accommodation space formed in each of the plurality of pairs of sheaths and a transmission cable arranged in the accommodation space of the each of the pairs of sheaths, wherein a length of the transmission cable is longer than a length of the sheath, and the transmission cable slides within the accommodation space of the sheath; wherein each of the actuating units comprises:

a frame provided with an upper plate including two through holes, a backplate, a bottom plate and a support with a through hole, wherein the upper plate is fixed on one end of the backplate, and the bottom plate is fixed on another end of the backplate, so that bottom plate and the upper plate are in-parallel positioned at one side of the backplate with a height of the backplate in between, and the bottom plate is fixed to the support;

a motor equipped on the support and provided with a shaft passing through the through hole on the support;

a cylindrical spinner is connected to the shaft and provided with two parallel grooves with space in between, and a pair of fixing points is positioned on an end of the cylindrical spinner;

a tension sensing unit arranged on the bottom plate and provided with an elastic pulley, an elastic sensing rod, and a tension sensor fixed on the bottom plate, the elastic sensing rod connecting the tension sensor and the elastic pulley; wherein each pairs of sheaths is connected to the hand assistive unit with one end and the two through holes on the upper plate with another end, so that one end of each transmission cable connects the driving shaft, and another end of each transmission cable passes around the elastic pulley and contacts one of the two parallel grooves and then fixes on the pair of fixing points with a terminal.

2. The wearable hand rehabilitation system according to claim 1, further comprises a link plate with one end fixed to the support.

3. The wearable hand rehabilitation system according to claim 2, wherein a photo interrupter is arranged on another end relative to the one end of the link plate that is towards the backplate, and the photo interrupter is positioned right on the cylindrical spinner.

4. The wearable hand rehabilitation system according to claim 3, further comprises a baffle arranged on another side end of the cylindrical spinner and has a radius bigger than radius of the cylindrical spinner.

5. The wearable hand rehabilitation system according to claim 1, wherein a rigid pipe is set to pass through each of the through holes on the upper plate.

6. The wearable hand rehabilitation system according to claim 5, wherein a knurled head is arranged on an open end of the rigid pipe that is protruded onto the upper plate.

7. The wearable hand rehabilitation system according to claim 1, wherein the plurality of pairs of sheaths are made of flexible material.

8. The wearable hand rehabilitation system according to claim 1, wherein a rigid tube is arranged on the perforation of the cover.

9. The wearable hand rehabilitation system according to claim 8, wherein each of the sheaths enters into the base via the rigid tube.

10. The wearable hand rehabilitation system according to claim 1, further comprises a servo control unit equipped onto the base plate.

* * * * *